US008180246B2

(12) United States Patent
Kawahara et al.

(10) Patent No.: US 8,180,246 B2
(45) Date of Patent: May 15, 2012

(54) IMAGE FORMING APPARATUS

(75) Inventors: Shinichi Kawahara, Tokyo (JP); Masumi Sato, Yokohama (JP); Nobuyuki Koinuma, Yokohama (JP); Kazuhisa Sudo, Kawasaki (JP); Tokuya Ojimi, Kawasaki (JP); Kazuhiko Yuki, Kawasaki (JP); Kohsuke Yamamoto, Numazu (JP); Takehide Mizutani, Sagamihara (JP); Masaki Sukesako, Kawasaki (JP); Ryuji Yoshida, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 428 days.

(21) Appl. No.: 12/542,289

(22) Filed: Aug. 17, 2009

(65) Prior Publication Data

US 2010/0040393 A1 Feb. 18, 2010

(30) Foreign Application Priority Data

Aug. 18, 2008 (JP) ..... 2008-209903
Jun. 22, 2009 (JP) ..... 2009-147855

(51) Int. Cl.
*G03G 15/16* (2006.01)
*G03G 21/00* (2006.01)

(52) U.S. Cl. ..... 399/101; 399/98; 399/358

(58) Field of Classification Search ..... 399/101, 399/98, 99, 358, 359
See application file for complete search history.

(56) References Cited

U.S. PATENT DOCUMENTS 4,975,748 A 12/1990 Koinuma et al.
5,864,733 A 1/1999 Mae et al.
5,909,609 A 6/1999 Yahata et al.
6,141,521 A 10/2000 Yuuki et al.
6,337,957 B1 1/2002 Tamaki et al.
6,507,718 B2 1/2003 Ohjimi et al.
6,522,855 B1 2/2003 Katoh et al.
6,603,943 B2 8/2003 Yuuki et al.
6,687,474 B2 2/2004 Yamada et al.
6,690,896 B2 2/2004 Hanada et al.
6,813,467 B2 11/2004 Kawahara et al.

(Continued)

FOREIGN PATENT DOCUMENTS

JP 08015948 A * 1/1996

(Continued)

OTHER PUBLICATIONS

Machine translation of reference Maeda (Pub No. JP 2001-175,048 A) Pub date Jun. 29, 2001.*

(Continued)

*Primary Examiner* — David Gray
*Assistant Examiner* — Rodney Bonnette
(74) *Attorney, Agent, or Firm* — Oblon, Spivak, McClelland, Maier & Neustadt, L.L.P.

(57) ABSTRACT

An image forming apparatus includes multiple image forming units disposed adjacent to and horizontally aligned with each other to form respective single non-black color images, a first transfer member to sequentially transfer and overlay the respective single non-black color images thereon for forming a composite color image, a black image forming unit disposed separately from the multiple image forming units including a black image carrier and a black image developing unit, a second transfer member to transfer the black image from the black image forming unit onto a recording medium, a first cleaning unit to clean the surface of the black image carrier, and a second cleaning unit to clean the surface of the second transfer member. The black toner removed from the surface of the black image carrier is collected to the black image developing unit.

10 Claims, 11 Drawing Sheets

U.S. PATENT DOCUMENTS

| | | | | |
|---|---|---|---|---|
| 6,856,774 | B2 | 2/2005 | Sampe et al. | |
| 6,873,814 | B2 | 3/2005 | Sasaki et al. | |
| 6,961,535 | B2 | 11/2005 | Kawahara et al. | |
| 7,043,182 | B2 | 5/2006 | Sakai et al. | |
| 7,106,991 | B2 | 9/2006 | Hosokawa et al. | |
| 7,184,691 | B2 | 2/2007 | Kita et al. | |
| 7,212,773 | B2 | 5/2007 | Sudo et al | |
| 2002/0067938 | A1* | 6/2002 | Saitoh et al. | 399/359 |
| 2003/0108365 | A1* | 6/2003 | Kabai | 399/297 |
| 2004/0223779 | A1* | 11/2004 | Satoh | 399/98 |
| 2005/0265759 | A1* | 12/2005 | Takeuchi et al. | 399/359 |
| 2006/0115286 | A1* | 6/2006 | Uchitani et al. | 399/50 |
| 2007/0140747 | A1 | 6/2007 | Kita et al. | |
| 2007/0212117 | A1 | 9/2007 | Itoh et al. | |
| 2007/0212119 | A1 | 9/2007 | Kurenuma et al. | |
| 2007/0223957 | A1* | 9/2007 | Shimmura | 399/101 |
| 2008/0193161 | A1 | 8/2008 | Sano et al. | |
| 2009/0169236 | A1* | 7/2009 | Fukao et al. | 399/99 |
| 2010/0061752 | A1* | 3/2010 | Sudo et al. | 399/66 |
| 2011/0013950 | A1 | 1/2011 | Furuya et al. | |

FOREIGN PATENT DOCUMENTS

| | | | |
|---|---|---|---|
| JP | 2000-35703 | | 2/2000 |
| JP | 2001175048 | A * | 6/2001 |
| JP | 2002296867 | A * | 10/2002 |
| JP | 08-063067 | | 11/2002 |
| JP | 2002-357938 | | 12/2002 |
| JP | 2002-365995 | | 12/2002 |
| JP | 2006-30519 | | 2/2006 |

OTHER PUBLICATIONS

Machine translation of reference Suzuki (Pub No. JP 08-015,948 A) Pub date Jan. 19, 1996.*

Machine translation of reference Shigeta et al. (Pub No. JP 2002-296,867 A) Pub date Oct. 9, 2002.*

* cited by examiner

IMAGE FORMING APPARATUS

CROSS-REFERENCE TO RELATED APPLICATIONS

The present invention claims priority pursuant to 35 U.S.C. §119 from Japanese Patent Application No. 2008-209903, filed on Aug. 18, 2008 in the Japan Patent Office, and Japanese Patent Application No. 2009-147855, filed on Jun. 22, 2009 in the Japan Patent Office, which are hereby incorporated by reference herein in their entirety.

BACKGROUND OF THE INVENTION

1. Field of the Invention

Exemplary embodiments of the present invention generally relate to an image forming apparatus, and more particularly, to an image forming apparatus that includes a collection mechanism for recycling toner remaining on an image transfer member after image transfer.

2. Discussion of the Related Art

Related-art image forming apparatuses such as copiers, printers, facsimile machines, and printing presses generally include a developing unit, which develops an electrostatic latent image formed on a photoconductor or an image carrier into a visible image, and a transfer unit that transfers the visible image onto a sheet-like recording medium so as to output an image.

Such image forming apparatuses include either a single photoconductor or multiple photoconductors.

In addition to production of monochrome images, the single photoconductor can output a full-color image by sequentially forming visible images developed with respective toners of complementary colors using a color separation technique and transferring the images onto a recording medium either directly or via an intermediate transfer member.

By contrast, the multiple photoconductors each form respective single color images that are then transferred onto the intermediate transfer member to form an overlaid toner image. The multiple photoconductors may be incorporated in separate respective image forming units and disposed along the intermediate transfer member, the configuration of which is called a tandem-type configuration.

The tandem-type image forming apparatus consumes black toner frequently in the course of producing full-color images, monochrome images, and pictorial full-color images, or for the purpose of color tone adjustment. Therefore, as part of a recent trend of conserving resources, residual toner remaining on an image carrier after image transfer is collected to re-use for development as recycled toner. Recycled toner can be used in both monochrome image forming and full-color image forming operations.

To accomplish such recycling, in a tandem-type image forming apparatus that incorporates separate image carriers corresponding to each toner color, a cleaning unit is provided for removing toner from each image carrier. With this configuration, it is easy to collect and return the residual toner to a developing unit of each toner color for recycling for image formation.

Since the respective image forming units are independent of each other, in theory the tandem-type image forming apparatus as described above should have no mixing of toner colors in the collected toner. However, mixing of toner colors can occur during the image transfer process, in which a toner image is transferred from an image carrier onto a recording medium.

There are several reasons for such mixing of toner of different colors. For example, when forming an overlaid color toner image in the tandem-type image forming apparatus, a first toner image formed on a first image carrier is transferred onto a recording medium conveyed by a sheet transfer member, then a second toner image formed on a second image carrier disposed downstream from the first image carrier is overlaid on the first toner image on the recording medium, and this operation is repeated until a toner image formed on an image carrier farthest downstream is transferred onto the recording medium.

When the downstream-side toner image is transferred onto the recording medium, the toner on the upstream-side toner image that is already carried on the recording medium can reversely be transferred onto the surface of the downstream-side image carrier and is then collected by a cleaning unit for the downstream-side toner. Thus, the upstream-side toner and the downstream-side toner are mixed together. In other words, the first toner carried by a recording medium is reversely transferred onto a second image carrier and is collected by a second cleaning unit. The mixing of toners can also occur in the related-art image forming apparatus with the intermediate transfer system including the intermediate transfer member.

Consequently, when the related-art color image forming apparatus causes toner of each image carrier to be collected and returned to a corresponding developing unit for the purpose of recycling, hue of toner in the developing unit gradually but largely changes, becoming increasingly mixed with time.

Various techniques for known image forming apparatuses have been proposed to eliminate the above-described problem.

In one example of a known image forming apparatus, a black image carrier is located at an extreme upstream side or a first position in an order of image transfer, so that black toner collected from the black image carrier does not get mixed with other colors and can be conveyed to a corresponding developing unit for recycling.

In another example of a known image forming apparatus, toner of mixed color is mixed with black toner to be used as black toner.

Yet another example of a known image forming apparatus has a configuration in which collected toner can be selectively used or entirely discarded.

Further, yet another example of a known image forming apparatus includes a developing unit only for mixed toner.

At present, image forming apparatuses capable of producing color images currently on the market are used at a rate of 70% to 80% to produce monochrome (black-and-white) images. Since black toner is consumed when producing full-color image as well as monochrome image, a relatively large proportion of waste toner consists of black toner. Therefore, even when color toners other than black toner are discarded while the black toner is collected for reuse, in effect substantially all collected toner is not discarded but is practically reused.

As an example, FIG. 1 illustrates a schematic configuration of an image forming mechanism of a generally known image forming apparatus 100. The known image forming apparatus 100 includes image carriers 102K, 102Y, 102M, and 102C and an intermediate transfer belt 115. The image carriers 102K, 102Y, 102M, and 102C are aligned horizontally and rotate in directions identical to each other as indicated by arrows A shown in FIG. 1.

An outer surface of the intermediate transfer belt 115 that forms an endless loop and is extended by supporting rollers contacts the image carriers 102K, 102Y, 102M, and 102C and rotates with the image carriers 102K, 102Y, 102M, and 102C in a direction indicated by arrows B in FIG. 1. In the image forming apparatus 100 of FIG. 1, the image carrier 102K forms monochrome or black (K) images, the image carrier 102Y forms yellow (Y) images, the image carrier 102M forms magenta (M) images, and the image carrier 102C forms cyan (C) images.

The image carrier 102K for forming black images, together with a corresponding developing unit, not shown, are disposed at a far upstream side in the direction B of rotation of the intermediate transfer belt 115, and therefore of all the image carriers are located farthest from a transfer position S where a toner image formed on the outer surface of the intermediate transfer belt 115 is transferred onto a transfer sheet as a recording medium.

Because of the above-described location of the image carrier 102K within the array of image carriers, even though formation of monochrome or black images is the most common of all image forming operations of apparatuses currently on the market, additional time is needed from development of the black image to transfer of the black image onto a recording medium or a transfer sheet. Therefore, not only does a user have to wait from execution of a printing request to completion of printout of the transfer sheet, but also the image forming carriers 102K, 102Y, 102M, and 102C of the image forming apparatus 100 are required to keep idling. In particular, the idling of units unnecessary for forming black images, i.e., the image forming carriers 102Y, 102M, and 102C, of the image forming apparatus 100 can accelerate wear of parts and components used during the idling of the image forming carriers 102Y, 102M, and 102C and shorten the useful life period of the parts and components.

In another related-art image forming apparatus, the mixing of toner of different colors in the collected toner is controlled to remain at or below a predetermined level for recycling in a developing unit for black toner. However, the mixed toner can change the color tone of black toner and degrade the quality of a printed image.

In yet another related-art image forming apparatus, whether to reuse or discard the collected toner is determined by switching a direction of rotation of toner conveyance screws disposed within the individual units. Since a cleaning unit of the related-art image forming apparatus contains mixed toner, even if an amount of toner used for forming each image is obtained by counting the pixels, the calculation actually results in an integral value, making it difficult to accurately estimate the degree of mixed toner in the collected toner.

In some other known image forming apparatuses, a dedicated developing unit dedicated to mixed toner and a dedicated image carrier are incorporated. Consequently, the number of units increases, which can lead to an increase in size of the known image forming apparatus and an increase in manufacturing costs of the known image forming apparatus.

To eliminate such problems, a related-art image forming apparatus 200 shown in FIG. 2 includes four image forming units 220Y, 220M, 220C, and 220K including image carriers 202Y, 202M, 202C, and 202K, and an intermediate transfer belt 215. The image carrier 202Y forms yellow (Y) images, the image carrier 202M forms magenta (M) images, the image carrier 202C forms cyan (C) images, and the image carrier 202K forms black (K) images. The related-art image forming apparatus 200 shown in FIG. 2 employs a tandem-type system. In this case, in the tandem-type image forming apparatus 200, the image forming units 220Y, 220M, and 220C are disposed along the intermediate transfer belt 215 in contact with an outer surface of the intermediate transfer belt 215. The image forming unit 220K of the related-art image forming apparatus 200 is separated from the image forming units 220Y, 220M, and 220C and is located upstream from the image forming units 220Y, 220M, and 220C in a direction of conveyance of a transfer sheet or recording medium. That is, the image forming unit 220K of the related-art image forming apparatus 200 can transfer a black image formed thereon onto the transfer sheet before a composite color image that includes colors other than black is transferred onto the transfer sheet.

As described above, the related-art image forming apparatus 200 shown in FIG. 2 can transfer the black image onto the transfer sheet before the composite color image of yellow, magenta, and cyan images to the transfer sheet. With this configuration, when only a black image or monochrome image is required to be output, the black image transferred onto a black image transfer unit can be electrostatically attracted to the transfer sheet at a position facing a sheet conveyance unit. Therefore, the black or monochrome image can be transferred onto the transfer sheet more quickly than the composite color image, that is, the transfer of black or monochrome images can reduce the operating time.

However, unlike the image forming units 220Y, 220M, and 220C that are held in contact with the intermediate transfer belt 215, the image forming unit 220K includes the black image transfer unit. The black image transfer unit receives the toner image from the image carrier 202K and contacts the transfer sheet directly to transfer the black image onto the transfer sheet, one consequence of which is that the black image transfer unit can acquire more paper dust on the surface thereof than the other units. Particularly when transfer sheets having a width smaller than a maximum passable transfer sheet width of each image carrier are conveyed frequently, paper dust from the transfer sheets can accumulate at the same position on a cleaning blade of a cleaning unit of each image carrier. Examples of such transfer sheets are recycled paper, medium quality paper, paper with additives, and the like.

As a result, when residual toner after image transfer is returned to a developing unit disposed in the image unit 220K for black toner image, paper dust can also be collected to accumulate with the residual toner. The accumulation of paper dust in the developing unit can cause the following problems.

When being mixed with the residual toner, the paper dust can easily accumulated in the developing unit, specifically between a developer carrier and a doctor blade that regulates a thickness or height of developer on the surface of the developer carrier. Blockage of the developer at a portion where paper dust is accumulated can cause a decrease in amount of attraction of the developer, which can result in defective images such as images with white streaks.

Further, when paper dust blocked by the doctor blade is released to flow therethrough, the paper dust with the developer adhering to the surface of the transfer sheet can contaminate the transfer sheet, which may result in image degradation.

To avoid the above-described problems, the developing unit provided in the image forming unit 220K needs to be replaced before those of the image forming units 220Y, 220M, and 220C. This requirement can result in an increase in running cost of the image forming apparatus 200.

Moreover, unlike the image forming units 220Y, 220M, and 220C in which the composite color image is transferred onto the intermediate transfer belt 215 and then onto the transfer sheet, the black image formed by the image forming unit 220K is transferred from the black image transfer unit in the image forming unit 220K directly onto the transfer sheet. Therefore, the image quality ultimately depends on the surface properties of each transfer sheet.

As might be expected, the properties of transfer sheets can vary considerably. For example, one transfer sheet such as embossed paper has a smooth but uneven surface with convex and concave portions whereas another transfer sheet such as coarse paper has an unsmooth surface.

The surface properties of the transfer sheet affect to the transfer electric field that moves the toner from the units to ultimately the recording medium. In particular, fluctuations in the transfer electric field can affect transfer efficiency, such that an image transferred onto the transfer sheet can be a defective image of uneven density, for example.

An additional complicating factor is that an intermediate transfer unit includes an elastic layer on the surface of a sheet transfer member used in the intermediate transfer unit to enhance contact of the transfer sheet with the surface of the above-described sheet transfer member. Some materials that are used for the elastic layer can hinder formation of transfer electric field by a direct contact.

As described above, the image forming unit 220K includes the black image transfer unit that directly contact the transfer sheet. Due to differences in the surface properties of the transfer sheets that contact the black image transfer unit of the image forming unit 220K, the transferability of black images formed by the image forming unit 220K can become inferior to that of the composite color image formed by the image forming units 220Y, 220M, and 220C. Given the high rates of utilization of the image forming unit 220K including the black image transfer unit that is typical of image forming apparatuses currently on the market, such loss of transferability is particularly to be avoided.

SUMMARY OF THE INVENTION

Exemplary aspects of the present invention have been made in view of the above-described circumstances.

Exemplary aspects of the present invention provide an image forming apparatus that can effectively reuse residual toner as recycled toner without including a large proportion of paper dust.

In one exemplary embodiment, an image forming apparatus includes multiple image forming units, a first transfer member, a black image forming unit, a second transfer member, a first cleaning unit, and a second cleaning unit. The multiple image forming units are disposed adjacent to and horizontally aligned with each other to form respective single non-black color images. The first transfer member extends along and disposed in contact with the multiple image forming units to sequentially transfer and overlay the respective single non-black color images onto an extended surface thereof for forming a composite color image. The black image forming unit is disposed separately from the multiple image forming units to form a black image. The black image forming unit includes a black image carrier to carry the black image on a surface thereof and a black image developing unit to develop the black image with black toner. The second transfer member is disposed facing the black image carrier of the black image forming unit to transfer the black image from the black image forming unit onto a recording medium. The first cleaning unit is disposed facing the black image carrier to clean the surface of the black image carrier. The second cleaning unit is disposed facing the second transfer member to clean the surface of the second transfer member. The black toner removed from the surface of the black image carrier is collected and returned to the black image developing unit.

The second transfer member may be disposed where the black image is transferred onto the recording medium before the composite color image is transferred onto the recording medium.

The second cleaning unit may discard toner and paper dust collected from the surface of the second transfer member.

The surface of the second transfer member may include an elastic layer.

The toner may contain particles having an average circularity of from approximately 0.92 to approximately 1.00.

The toner may contain particles having a shape factor SF-1 in a range of from approximately 100 to approximately 180, and a shape factor SF-2 in a range of from approximately 100 to approximately 180.

The toner may contain particles having a volume-based average particle diameter from approximately 3 μm to approximately 8 μm and a distribution of from approximately 1.05 to approximately 1.40. The distribution may be defined by a ratio of the volume-based average particle diameter to a number-based average diameter.

The toner may contain particles having a ratio of a major axis r1 to a minor axis r2 of from approximately 0.5 to approximately 1.0, and a ratio of a thickness r3 to the minor axis r2 of from approximately 0.7 to approximately 1.0, and $r1 \geqq r2 \geqq r3$.

The toner may contain particles obtained from at least one of an elongation and a crosslinking reaction of toner composition comprising a polyester prepolymer having a function group including a nitrogen atom, a polyester, a colorant, and a releasing agent in an aqueous medium under resin fine particles.

The multiple image forming units may include respective process cartridges, in each of which an image carrier and at least one of a charging unit, a developing unit, and a cleaning unit are integrally provided therein. The black image forming unit may include a black process cartridge in which the black image carrier and at least one of a black image charging unit, the black image developing unit, and a black toner cleaning unit are integrally provided therein. The multiple process cartridges and the black process cartridge may be detachably attachable to the image forming apparatus. The black toner removed from the black image carrier in the process cartridge may be collected as recycled toner and returned to the black image developing unit of the black process cartridge for forming black toner images.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
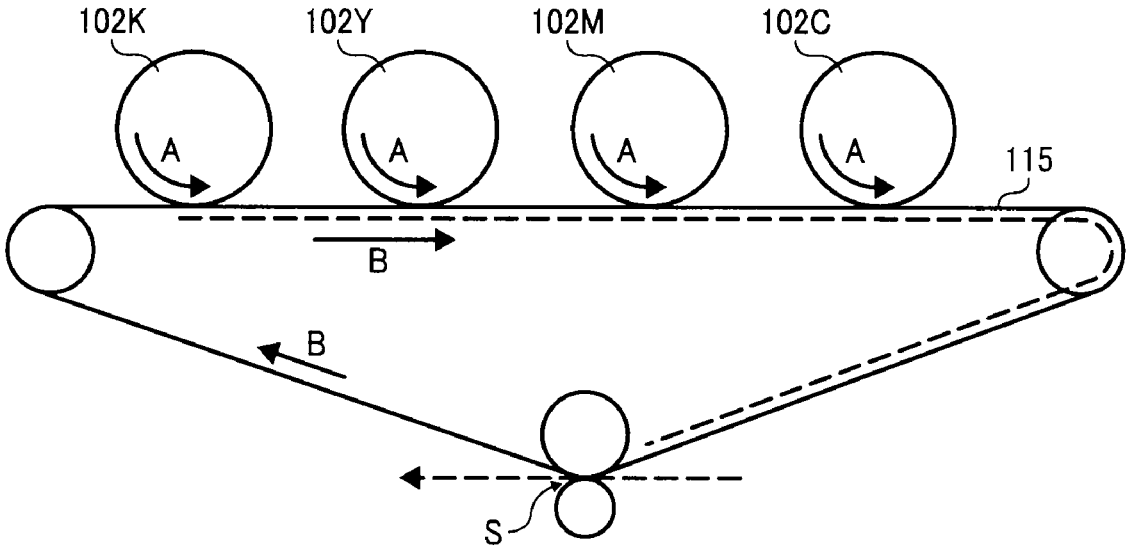
FIG. 1 BACKGROUND ART
FIG. 1 is a schematic view of an image forming mechanism of a related-art image forming apparatus employing a tandem type system.
Figure 2:
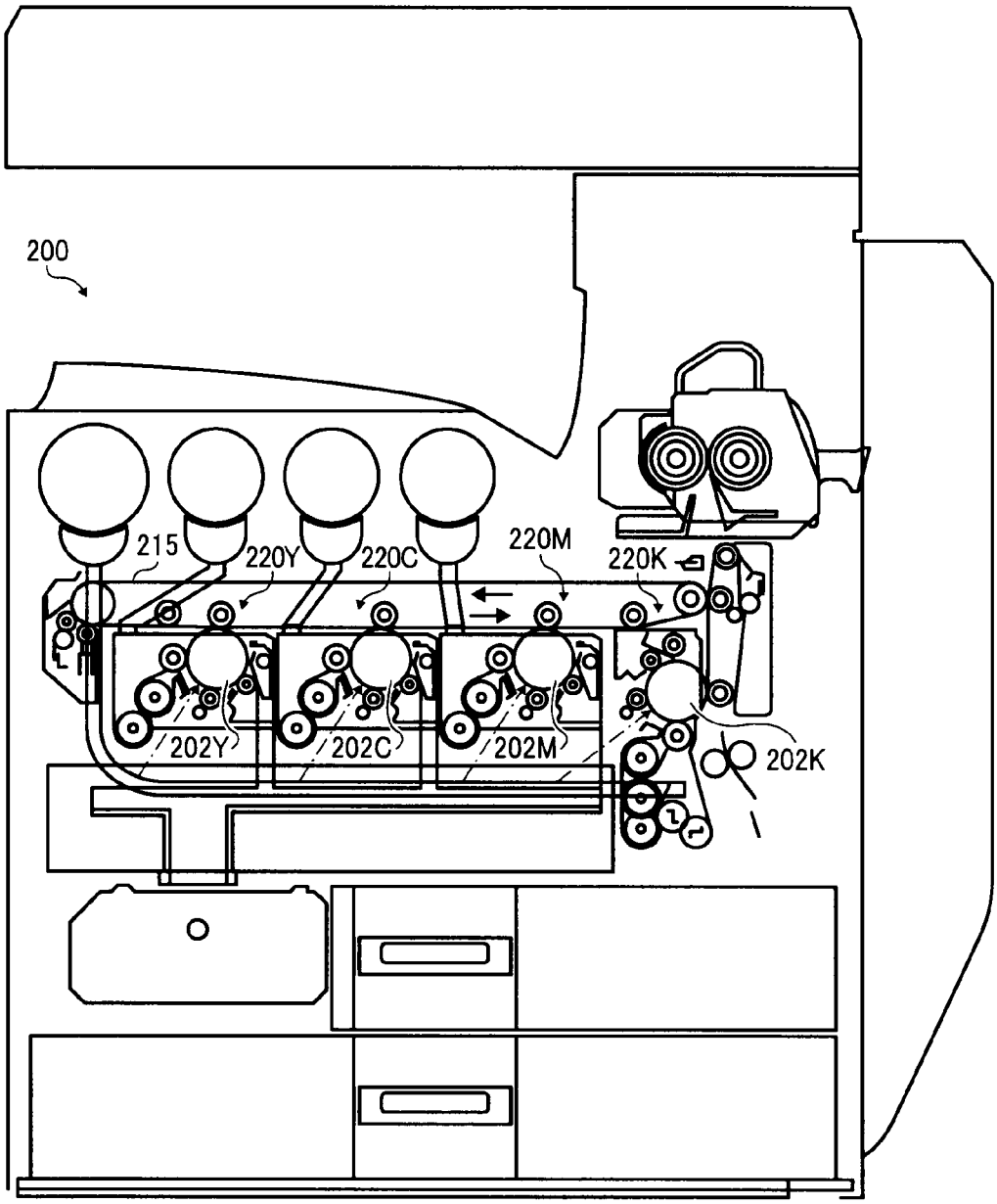
FIG. 2 BACKGROUND ART
FIG. 2 is a schematic view of another related-art image forming apparatus employing a tandem type system different from the image forming apparatus of FIG. 1.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would hen be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, exemplary embodiments of the present invention are described.

Now, exemplary embodiments of the present invention are described in detail below with reference to the accompanying drawings.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus. For example, the technique of the present invention is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 3:
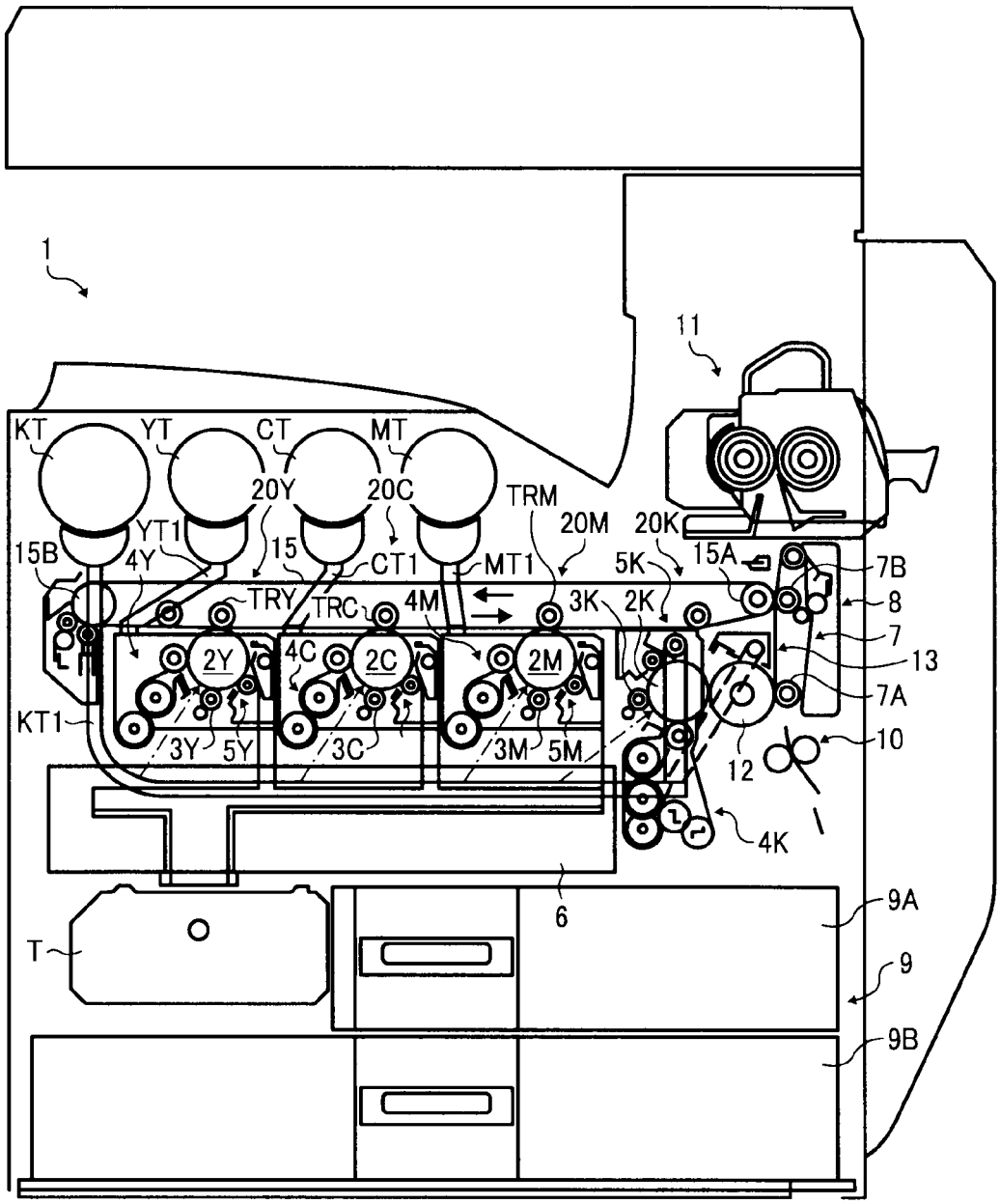
FIG. 3 is a schematic view of an image forming apparatus according to an exemplary embodiment of the present invention.

FIG. 3 is a drawing of a schematic configuration of an image forming apparatus 1 according to an exemplary embodiment of the present invention.

The image forming apparatus 1 can be any of a copier, a printer, a facsimile machine, a plotter, and a multifunction printer including at least one of copying, printing, scanning, plotter, and facsimile functions. In this non-limiting exemplary embodiment, the image forming apparatus 1 functions as a full-color printing machine for electrophotographically forming a toner image based on image data on a recording medium (e.g., a transfer sheet).

The toner image is formed with four single toner colors, which are yellow, cyan, magenta, and black. Reference symbols "Y", "C", "M", and "K" represent yellow color, cyan color, magenta color, and black color, respectively.

The image forming apparatus 1 of FIG. 3 corresponds to a printer, copier, facsimile machine, etc. and employs a tandem type indirect transfer system. However, compared to a regular tandem type indirect transfer system in which four image forming units are held in contact with the outer surface of an intermediate transfer member, the image forming apparatus 1 of FIG. 3 employs a tandem type indirect transfer system in which three image forming units other than black image forming unit are disposed in contact with the outer surface of the intermediate transfer member. That is, the black image forming unit is disposed independent of the other three image forming units and disposed opposite a black image transfer unit that is dedicated to the black image forming unit.

Specifically, the image forming apparatus 1 of FIG. 3 includes image forming units 20Y, 20C, 20M, and 20K that serve as image carriers and an intermediate transfer belt 15 that serves as an intermediate transfer member incorporated in an intermediate transfer unit. The image forming units 20Y, 20C, 20M, and 20K are disposed below the intermediate transfer belt 15.

The intermediate transfer belt 15 is extended by and spanned around multiple supporting rollers including rollers 15A and 15B and rotates in a direction indicated by an arrow shown in FIG. 3.

The roller 15A serves as a drive member of the intermediate transfer belt 15 and is disposed facing a transfer roller 7B for transferring a composite color image onto a transfer sheet. The transfer roller 7B is incorporated in a conveyance unit 7, the components and function of which are described later.

Here, the transfer sheet serves as a recording medium and corresponds to a sheet-like transfer material. However, the transfer material that can be used in the image forming apparatus 1 is not limited to the above-described transfer sheet.

The intermediate transfer belt 15 includes an elastic member. As described above, the extended outer surface at lower side of the intermediate transfer belt 15 contacts the image forming units 20Y, 20M, and 20C.

The image forming units 20Y, 20C, and 20M have a similar structure and functions to each other, except that the colors of toners are different from each other. Therefore, the following description of the configuration is made focusing on the image forming unit 20Y.

The image forming unit 20Y (20C, 20M) includes a photoconductor 2Y (2C, 2M), a charging unit 3Y (3C, 3M), a developing unit 4Y (4C, 4M), and a cleaning unit 5Y (5C, 5M). The photoconductor 2Y is a drum-shaped image carrier and rotates in a clockwise direction in FIG. 3. The charging unit 3Y, the developing unit 4Y, and the cleaning unit 5Y are disposed in this order around the photoconductor 2Y so that the image forming unit 20Y can form a yellow image.

By contrast, the image forming unit 20K is disposed independent of the image forming units 20Y, 20C, and 20M so that a black image can be transferred onto a transfer sheet or other transfer material prior to a three-color composite image formed by the image forming units 20Y, 20C, and 20M. In other words, the image forming unit 20K is disposed upstream from a transfer position of the three-color composite image of the image forming units 20Y, 20C, and 20M in a direction of movement of the transfer sheet.

The image forming unit 20K also includes a photoconductor 2K, a charging unit 3K, a developing unit 4K, and a cleaning unit 5K.

According to the configuration, toner included in the three-color composite image may not be included in a black image transfer member 12 for transferring a black image.

The photoconductor 2K, which is also a drum-shaped image carrier for forming a black image, rotates in a counter-clockwise direction in FIG. 3. The photoconductor 2K rotates with the black image transfer member 12 to sandwich the transfer sheet therebetween to transfer the black image onto the transfer sheet.

The image forming apparatus 1 further includes toner supply tanks KT, YT, CT, and MT. The toner supply tanks KT, YT, CT, and MT are connected to the developing units 4K, 4Y, 4C, and 4M, respectively, via supplying pipes KT1, YT1, CT1, and MT1, respectively. When an amount of toner in any one of the developing units 4K, 4Y, 4C, and 4M becomes lower than a given amount, the toner is supplied from a corresponding one of the toner supply tanks KT, YT, CT, and MT to maintain a given constant density of developer in the developing units 4K, 4Y, 4C, and 4M.

Since functions of components around each of the image forming units 20K, 20Y, 20C, and 20M are similar to each other, the discussion below occasionally uses reference numerals without suffixes "K", "Y", "C", and "M" for specifying components of the image forming apparatus 1.

The image forming unit 20 integrally incorporates the photoconductor 2 and at least one of the charging unit 3, the developing unit 4, and the cleaning unit 5 as a process cartridge that is detachably attachable to the image forming apparatus 1.

In the image forming unit 20, the charging unit 3 uniformly charges the surface of the photoconductor 2 and an optical writing unit 6 emits a laser light beam to form an electrostatic latent image on the surface of the photoconductor 2 according to image data. The electrostatic latent image is developed by the developing unit 4 into a visible toner image.

In this exemplary embodiment, the optical writing unit 6 emits the laser light beams to the photoconductors 2Y, 2C, 2M, and 2K in the identical direction to each other so as to avoid the complexity or intersection of light paths of the laser light beams.

In the image forming unit 20K, a black image formed on the surface of the photoconductor 2K is transferred onto the black image transfer member 12. Then, the black image is not overlaid on a different image but is directly transferred onto the transfer sheet.

The black image transfer member 12 includes a roller that rotates with the photoconductor 2K. On one side from the axis of the black image transfer member 12, the black image transfer member 12 is disposed facing the photoconductor 2K to rotate with the photoconductor 2K for conveying the transfer sheet, and on the other side facing in contact with the conveyance unit 7.

The black image transfer member 12 electrostatically receives the black image from the photoconductor 2K of the image forming unit 20K and transfers the black image onto the transfer sheet. To perform this electrostatic transfer, the black image transfer member 12 has a polarity and bias potential to electrostatically transfer the black image with respect to the transfer sheet.

The conveyance unit 7 serves a conveyance belt unit that is disposed facing the black image transfer member 12 and includes a conveyance belt that is spanned around a pair of rollers to face the drive roller 15A that extends and supports the intermediate transfer belt 15.

The transfer unit 7 includes a transfer roller 7A and the transfer roller 7B.

The transfer roller 7A is disposed facing the black image transfer member 12 and also applies a transfer bias to the transfer sheet when transferring a black image onto the transfer sheet. The transfer bias of the transfer roller 7A is determined according to a transfer bias of the black image transfer member 12.

The transfer roller 7B is disposed facing the drive roller 15A of the intermediate transfer belt 15 via the conveyance unit 7.

For example, when the transfer bias of the black image transfer member 12 to transfer the black image onto the transfer sheet is not applied, the bias polarity of the transfer roller 7A is specified to electrostatically transfer toner on the black image carried by the black image transfer member 12 onto the transfer sheet with an electrostatic attractive force. Separately from the above, when the bias polarity to transfer the black image carried by the black image transfer member 12 onto the transfer sheet with an electrostatic repulsion is applied, another bias polarity that encourages the transfer is set or electrical floating is caused.

Further, the image forming apparatus 1 further includes transfer rollers TRY, TRC, and TRM as transfer member that has same function as the transfer roller 7B that serves as a biasing member. The transfer rollers TRY, TRC, and TRM are disposed facing the photoconductors 2Y, 2C, and 2M, respectively, via the intermediate transfer belt 15.

The conveyance unit 7 includes or is disposed adjacent a cleaning unit 8 that removes residual toner and paper dust adhering to the conveyance unit 7.

The image forming apparatus 1 further includes a sheet feed unit 9, a pair of registration rollers 10, and a fixing unit 11.

The sheet feed unit 9 includes sheet feed cassettes 9A and 9B, each of which can contain stack of transfer sheets. Each transfer sheet is fed from one of the sheet feed cassettes 9A and 9B and is conveyed toward the pair of registration rollers 10. When the transfer sheet is conveyed, the transfer sheet receives the black image or monochrome image via the black image transfer member 12 or an overlaid image of the black image and the composite color image of yellow, cyan, and magenta images.

In the image forming apparatus 1 according to an exemplary embodiment, when a monochrome image is transferred onto the transfer sheet, the black image formed on the photoconductor 2K of the image forming unit 20K is transferred via the black image transfer member 12 onto the transfer sheet. By contrast, when a full-color image is transferred onto the transfer sheet, the yellow, cyan, and magenta images are transferred and sequentially overlaid onto the intermediate transfer belt 15, the black image formed on the photoconductor 2K of the image forming unit 20K is transferred onto the transfer sheet, and then the three-color composite image formed on the intermediate transfer belt 15 is transferred and overlaid onto the black image formed on transfer sheet via the transfer roller 7B.

Further, a method for transferring a full-color image onto a transfer sheet is not limited to the above-described superimposing method. For example, the present invention can apply a method in which the black image transferred onto the black image transfer member 12 is transferred onto the conveyance unit 7, the black image on the conveyance unit 7 is transferred and overlaid onto the three-color composite image on the intermediate transfer belt 15, and then the four-color composite image is transferred onto the transfer sheet. In this case, the transfer of the black image from the conveyance unit 7 onto the intermediate transfer belt 15 is affected by a bias voltage applied by the transfer roller 7B.

The transfer sheet with the four-color composite image or the monochrome image thereon is conveyed to the fixing unit 11 that is disposed above the transfer position(s). The fixing unit 11 fixes the toner image to the transfer sheet.

The image forming apparatus 1 further includes a waste toner tank T that is located between the image forming units 20Y, 20C, and 20M and the sheet feed unit 9.

Further, residual toner that remains on the photoconductors 2Y, 2C, 2M, and 2K are removed by the cleaning units 5Y, 5C, 5M, and 5K, respectively. Residual toner that remains on the black image transfer member 12 are removed by a transfer member cleaning unit 13.

In this exemplary embodiment, the image forming units 20Y, 20C, 20M, and 20K, especially the image forming unit 20K, have feature in recycling of the residual toner.

The following description is given of the feature of the image forming unit 20K.

In the image forming unit 20K, the photoconductor 2K and the black image transfer member 12 includes the cleaning unit 5K and the transfer member cleaning unit 13, respectively, so that the residual toner collected by the cleaning unit 5K and the transfer member cleaning unit 13 can be conveyed to the developing unit 4K for recycling. However, the collected residual toner can be selectively conveyed to the developing unit 4K to re-use for development as recycled toner or to the waste toner tank T to discard as waste toner, according to a proportion of paper dust that is included in the residual toner.

A detailed description is given of the reasons of selection of the residual toner.

As described above, while the image forming units 20Y, 20C, and 20M transfer and overlay the single toner images onto the intermediate transfer belt 15 so as to form the three-color composite image and then transfers the three-color composite image onto the transfer sheet, the black image carried by the black image transfer member 12 is transferred onto the transfer sheet directly, which can easily produce paper dust of the transfer sheet to adhere to the black image transfer member 12. Therefore, paper dust may be mixed in the residual toner removed by the transfer member cleaning unit 13.

If such paper dust is mixed with the residual toner, when the residual toner is returned to the developing unit 4, the paper dust can be stuck or caught between the photoconductor 2 and a doctor blade used for regulating a thickness of layer of developer. This can cause an incorrect layer thickness regulation, and/or can be purged and adhere to the transfer sheet to cause contamination thereon.

To avoid the above-described problems, in this exemplary embodiment, when the transfer sheet includes a large proportion of paper dust or when a degradation in image quality is caused by the paper dust that is mixed with the developer, the residual toner removed from the black image transfer member 12 is basically discarded without being returned to the developing unit 4K and only the residual toner removed from the photoconductor 2K is retuned to the developing unit 4K. By so doing, the paper dust cannot be mixed in toner that is returned to the developing unit 4K to be re-used as recycled toner, and therefore the above-described problems caused by the developer including the paper dust can be eliminated or prevented.

Further, when the transfer sheet includes and generates a small proportion of paper dust and/or an amount of discarded residual toner is reduced, the residual toner removed from the black image transfer member 12 can also be returned to the developing unit 4K.

When the cleaning unit 5 performs a collection of residual toner, the setting of collection of residual toner removed from the black image transfer member 12 can be controlled by a controller 1000 provided to the image forming apparatus 1 through an operation panel 1001 mounted on the image forming apparatus 1.

Figure 4:
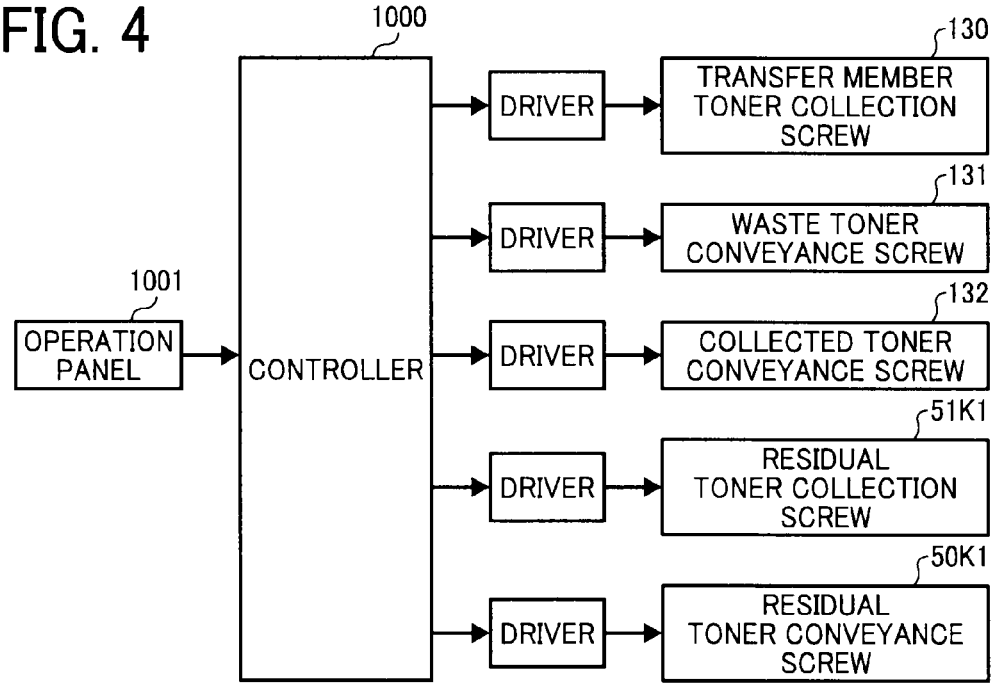
FIG. 4 is a block diagram of a schematic configuration of a controller in the image forming apparatus of FIG. 3.

FIG. 4 illustrates a block diagram of a configuration of the controller 1000 used in the image forming apparatus 1 according to this exemplary embodiment of the present invention.

In FIG. 4, the controller 1000 of the image forming apparatus 1 is connected to the operation panel 1001 as an input unit and to multiple drivers as output units.

One driver of the multiple drivers is connected to a black image transfer unit toner collection screw 130 that is provided in the cleaning unit 13 of the black image transfer member 12. Hereinafter, the black image transfer unit toner collection screw 130 is also referred to as a "transfer member toner collection screw 130".

Figure 6:
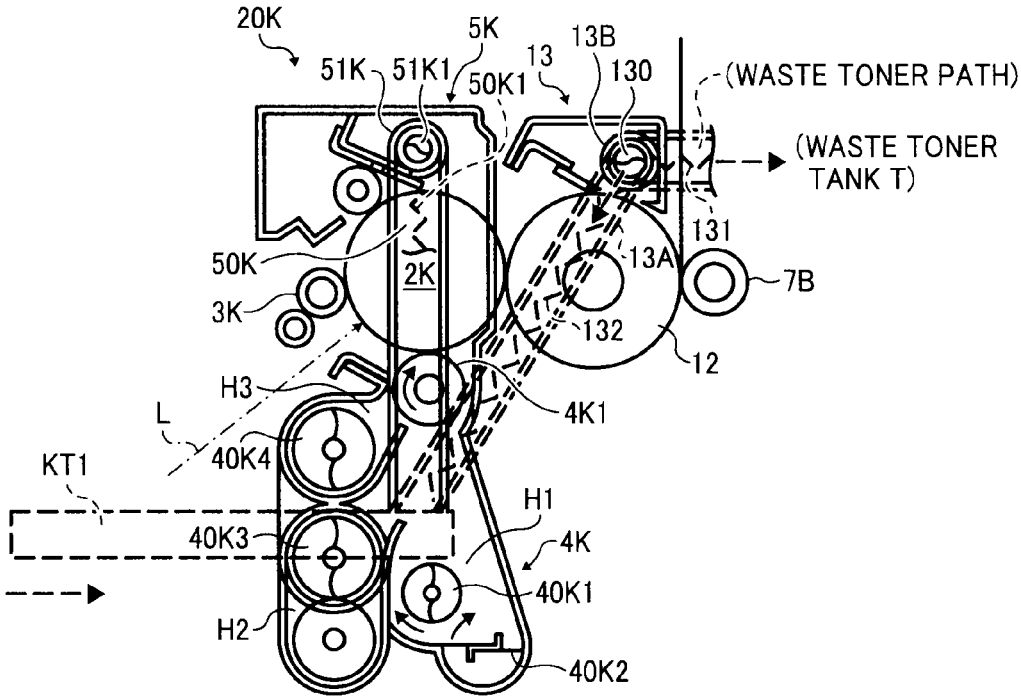
FIG. 6 is a schematic view of a black image forming unit of the image forming apparatus of FIG.

Another driver of the multiple drivers is connected to a waste toner conveyance screw 131 that is embedded in a residual toner discarding path or waste toner path (see FIG. 6). The waste toner path is extended between the waste toner tank T and one end in an axial direction of a residual toner collection unit 13B in which the transfer member toner collection screw 130 is provided.

Yet another driver of the multiple drivers is connected to a collected toner conveyance screw 132 that is mounted on a black image residual toner collection path 13A extended between the other end in the axial direction of the residual toner collection unit 13B and a developer agitation chamber H1 of the developing unit 4K.

In addition, another driver of the multiple drivers is connected to a black image photoconductor toner collection screw 51K1 (hereinafter referred to as a "residual toner collection screw 51K1") that is embedded in a black image photoconductor toner collection unit 51K (hereinafter referred to as a "residual toner collection unit 51K", see FIG. 6) provided to the cleaning unit 5K of the photoconductor 2K.

Yet another driver of the multiple drivers is connected to a black image photoconductor toner conveyance screw 50K1 (hereinafter referred to as a "residual toner conveyance screw 50K1") that is mounted on a black image photoconductor toner conveyance path 50K (hereinafter referred to as a "residual toner conveyance path 50K, see FIG. 6) extended between the residual toner collection unit 51K and the developer agitation chamber H1 of the developing unit 4K.

Figure 5:
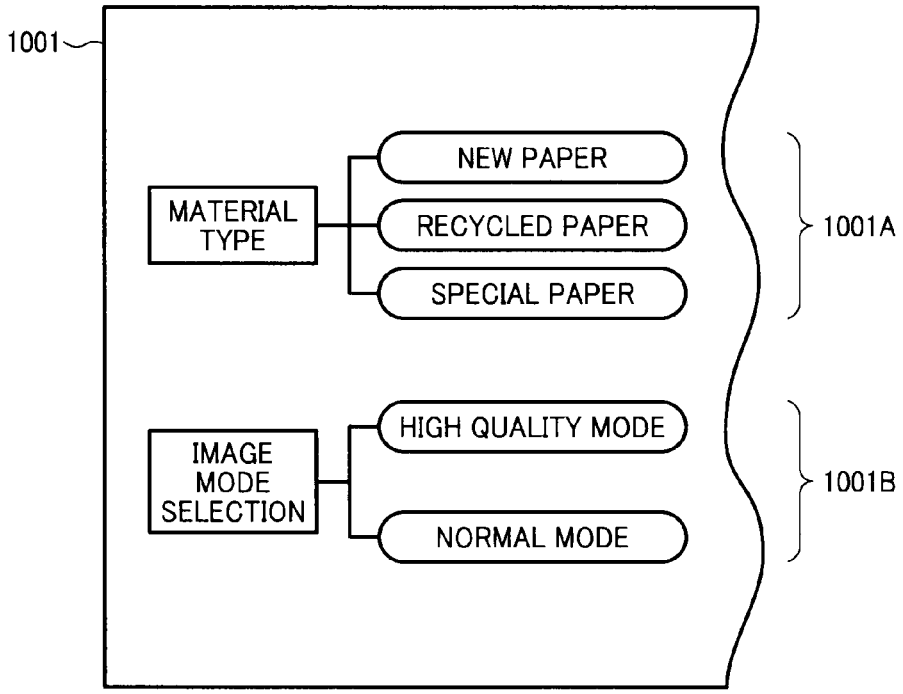
FIG. 5 is a schematic view of an operation panel connected to the controller of FIG. 4.

Referring to FIG. 5, a block diagram of a configuration of the operation panel 1001 is described.

As shown in FIG. 5, the operation panel 1001 includes a material type key 1001A that indicates material type of the transfer sheet and an image mode selection key 1001B that indicates image mode of the transfer sheet.

The material type key 1001A of the transfer sheet is a key to indicate a material of the transfer sheet to be used for determining the amount of possible production of paper dust. The types of transfer sheet specified in this case are virgin paper or new paper, recycled paper, medium quality paper, paper containing additives, and the like.

Data used to determine the possible amount of paper dust production from the transfer sheet is grouped and mapped based on information or results obtained by tests. The mapped data is registered in the controller 1000.

The image mode selection key 1001B is a key to select one of a high image quality mode and a normal image quality mode.

The high image quality mode is a mode by which toner with a small proportion of paper dust can be collected.

The normal image quality mode is a mode by which toner with a large proportion of paper dust is collected.

The information selected through the operation panel 1001 is used to set the conveyance condition of residual toner that is collected from the black image transfer member 12. When the large proportion of paper dust is included in the residual toner, the collected residual toner is discarded. When the small proportion of paper dust is included in the residual toner, the collected residual toner is returned to the developing unit 4K for recycling.

Referring now to FIG. 6, a description is given of the image forming unit 20K and components disposed around the image forming unit 20K.

In FIG. 6, the image forming unit 20K has a schematic structure as described below.

The image forming unit 20K of FIG. 6 includes the photoconductor 2K surrounded by the charging unit 3K, the developing unit 4K, the black image transfer member 12, and the cleaning unit 5K that removes residual toner from the photoconductor 2K after image transfer.

The charging unit 3K uniformly charges the surface of the photoconductor 2K, and the optical writing unit 6 emits the laser light beam L to irradiate the charged surface of the photoconductor 2K so as to form an electrostatic latent image according to image data.

The electrostatic latent image formed on the surface of the photoconductor 2K is developed by two-component developer, which includes carrier particles and toner particles supplied from the developing unit 4K, into a visible toner image.

The toner image developed by the toner particles of the two-component developer is transferred onto the black image transfer member 12, and is then transferred onto the transfer sheet that is held between the black image transfer member 12 and the conveyance unit 7 disposed facing the black image transfer member 12.

After the transfer of the black image onto the black image transfer member 12, the photoconductor 2K is cleaned by the cleaning unit 5K by removing residual toner on the surface thereof.

The cleaning unit 5K includes the residual toner conveyance path 50K and the residual toner conveyance screw 50K1.

The residual toner conveyance path 50K is defined by the developing unit 4K and the cleaning unit 5K.

The residual toner conveyance screw 50K1 is disposed in the residual toner conveyance path 50K.

The developing unit 4K includes multiple magnets and a development sleeve 4K1.

The multiple magnets respectively form a magnetic brush forming magnetic field, a developer conveyance magnetic field, a developer releasing magnetic field and the like.

The development sleeve can apply a development bias.

The developing unit 4K is separated by separation walls to form the developer agitation chamber H1, a developer conveyance chamber H2, and a developer supply chamber H3.

The developer agitation chamber H1 contains the developer that falls from the circumferential surface of the development sleeve 4K1 by action of a repulsive magnetic field of the developer releasing magnetic field formed in the development sleeve 4K1.

The developer conveyance chamber H2 communicates with the developer agitation chamber H1.

The developer supply chamber H3 communicates with the developer conveyance chamber H2.

The developer agitation chamber H1 includes a developer agitation screw 40K1 and a developer agitation paddle 40K2.

The developer conveyance chamber H2 includes a developer conveyance screw 40K3.

The developer supply chamber H3 includes a developer supply screw 40K4 that supplies the developer toward the development sleeve 4K1.

Figure 7:
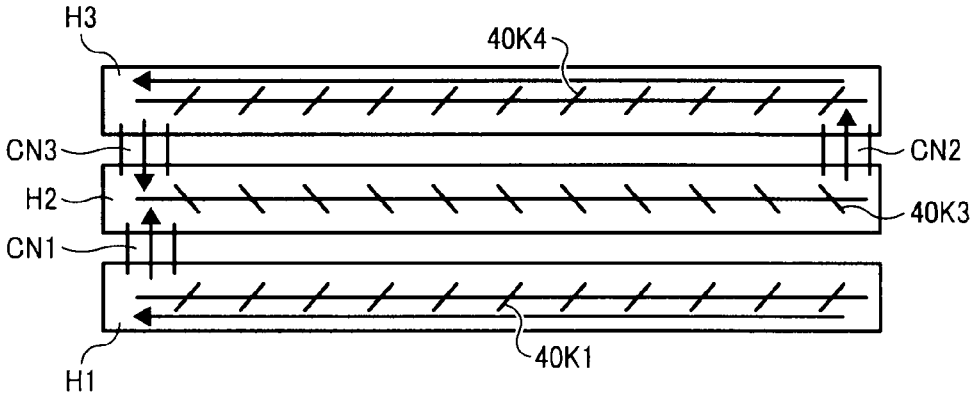
FIG. 7 is a schematic partial view of a developing unit of the black image forming unit of FIG. 6.
Figure 8:
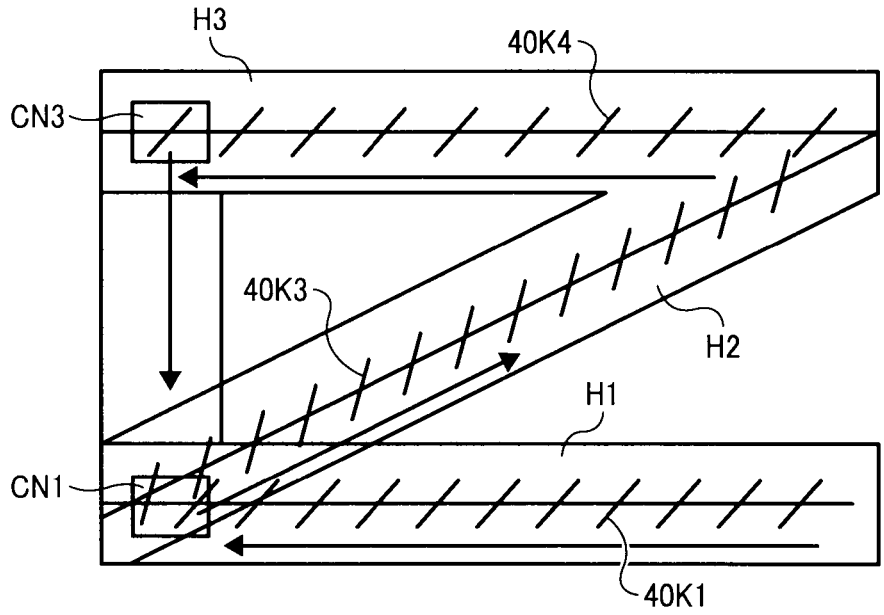
FIG. 8 is a schematic view of paths of developer that travels in a direction indicated by a dotted arrow in FIG. 6.
Figure 9:
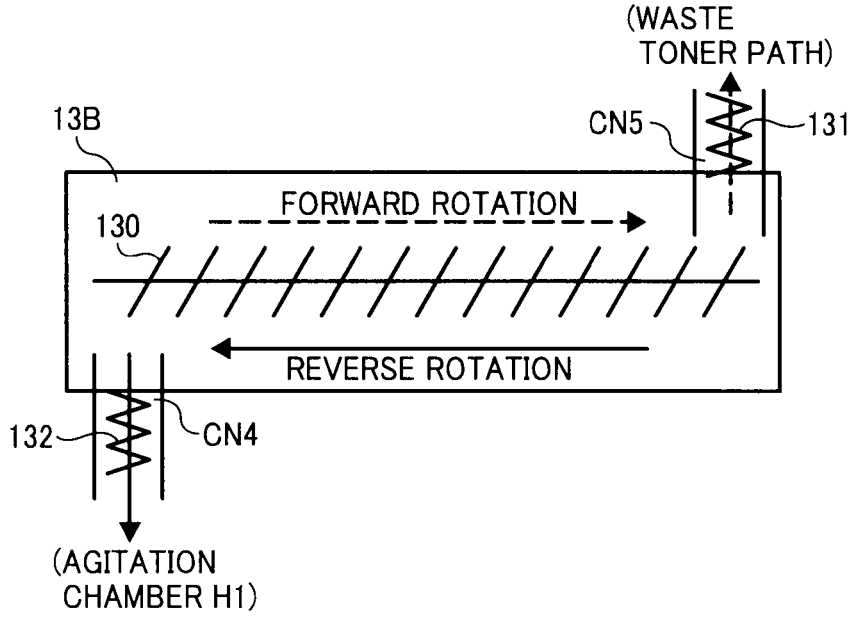
FIG. 9 is a schematic view of a cleaning unit of a black toner image transfer unit for the black image forming unit of FIG. 6.

The developer agitation chamber H1, the developer conveyance chamber H2, and the developer supply chamber H3 are partly in communication with each other, which is shown in FIGS. 7 through 9.

A description is given of the flow of developer, in reference to FIGS. 7 through 9.

As shown in FIG. 7, the developer can flow from the developer agitation chamber H1 to the developer conveyance chamber H2 through a connection opening CN1 that is disposed at a downstream side of the developer agitation chamber H1 in a direction to which the developer agitation screw 40K1 conveys the developer.

The movement of the developer from the developer agitation chamber H1 to the developer conveyance chamber H2 is based on that, as shown in FIG. 8, the developer conveyance screw 40K3 is formed aslant so that a part of the axis thereof is located lower than the axis of the developer agitation screw 40K1 from the near side to the far side in the drawing of FIG. 8. That is, on the downstream side in a direction of conveyance of the developer by the developer agitation screw 40K1, the developer conveyance screw 40K3 is located lower than the developer agitation screw 40K1. Therefore, a part of the developer conveyance chamber H2 where the developer conveyance screw 40K3 is located becomes lower than a lower circumferential surface of the developer agitation screw 40K1 of the developer agitation chamber H1.

By so doing, the developer that travels in the developer agitation chamber H1 falls in the developer conveyance chamber H2 due to gravity.

By contrast, the developer that moves from the developer conveyance chamber H2 to the developer supply chamber H3 is gradually pushed from the upstream side to the downstream side along a direction of slant of the developer conveyance screw 40K3. Therefore, when the developer arrives at a connection opening CN2, the developer is further pushed by the following developer to pass through the connection opening to move into the developer supply chamber H3.

In the developer supply chamber H3, the developer being conveyed is flipped up or pushed up by the developer supply screw 40K4 that extends along the development sleeve 4K1, whereby the developer can be supplied to the development sleeve 4K1. The developer that has reached the downstream side in a direction of conveyance thereof passes through a connection opening CN3 disposed thereat to return the developer to the developer conveyance chamber H2.

In FIG. 6, the developer agitation chamber H1 is connected to the toner supply path KT1 that supplies new toner to the developing unit 4K in a direction indicated by a dotted arrow and is also connected to the residual toner conveyance path 50K that is extended from the charging unit 5K of the photoconductor 2K. The residual toner conveyance path 50K corresponds to a return path of collected residual toner.

The residual toner conveyance screw 50K1 (only a part thereof is shown in FIG. 6) is provided in the residual toner conveyance path 50K. One axial end of the residual toner conveyance screw 50K1 is communicated with one axial end of the residual toner collection unit 51K in the cleaning unit 5K. The residual toner conveyance screw 50K1 (only a part thereof is shown in FIG. 6) that conveys the residual toner toward a connection opening, not shown, that is communicated with the residual toner conveyance path 50K is provided in the residual toner collection unit 51K.

In the above-described developer agitation chamber H1, newly supplied toner and the residual toner collected by the cleaning unit 5K are mixed with the carrier particles.

In addition to the connection with the residual toner conveyance path 50K for the residual toner collected from the photoconductor 2K by the cleaning unit 5K, the developer agitation chamber H1 is connected to the black image residual toner collection path 13A (hereinafter referred to as a "residual toner collection path 13A). The residual toner collection path 13A corresponds to one of other paths for the residual toner collected from the photoconductor 2K.

The residual toner collection path 13A is defined by the transfer member cleaning unit 13 disposed in the vicinity of the black image transfer member 12 for cleaning the surface of the black image transfer member 12 and the developer agitation chamber H1 of the developing unit 4K.

In FIG. 6, the transfer member cleaning unit 13 is connected with one axial end of the residual toner collection path 13A that is formed between the transfer member cleaning unit 13 and the developer agitation chamber H1 of the developing unit 4K. Specifically, the one axial end of the residual toner collection path 13A communicates with the residual toner collection unit 13B of the transfer member cleaning unit 13.

The residual toner collection unit 13B extends from the near side to the far side in the drawing sheet of FIG. 6. One axial end of the residual toner collection unit 13B communicates with the residual toner collection path 13A, as described above, and the other axial end thereof communicates with one longitudinal end of the waste toner path that is formed between the waste toner tank T (see FIG. 3) and the cleaning unit 13.

As shown in FIG. 9, the residual toner collection unit 13B includes the transfer member toner collection screw 130 that can rotate in both forward and backward directions to convey the residual toner collected from the black image transfer member 12. In the residual toner collection unit 13B, the transfer member toner collection screw 130 conveys the residual toner between both axial ends thereof, that is, between a connection opening CN4 communicating with the residual toner collection path 13A including the collected toner conveyance screw 132 and a connection opening CN5 communicating with the waste toner path including the waste toner conveyance screw 131, so as to convey the residual toner through the connection openings CN4 and CN5. Examples of a screw member used as a conveyance member of residual toner are the waste toner conveyance screw 131 that is provided in the waste toner path and the collected toner conveyance screw 132 that is provided in the residual toner collection path 13A.

As described above, the transfer member toner collection screw 130 can rotate in the forward and backward directions. That is, the residual toner is conveyed to the residual toner collection path 13A when the transfer member toner collection screw 130 rotates in the backward direction, and the residual toner is conveyed to the waste toner path when the transfer member toner collection screw 130 rotates in the forward direction. Therefore, the residual toner collected from the black image transfer member 12 is selectively rotated either to be returned to the developer agitation chamber H1 of the developing unit 4K or to be conveyed to the waste toner path according to a direction of rotation of the transfer member toner collection screw 130. The controller 1000 shown in FIG. 4 specifies the setting of conveyance of the residual toner.

In the configuration shown in FIG. 6, the axis of the above-described developer conveyance screw 40K3 has an angle or is inclined and the developer agitation chamber H1 includes the agitation paddle 40K2.

Figure 10:
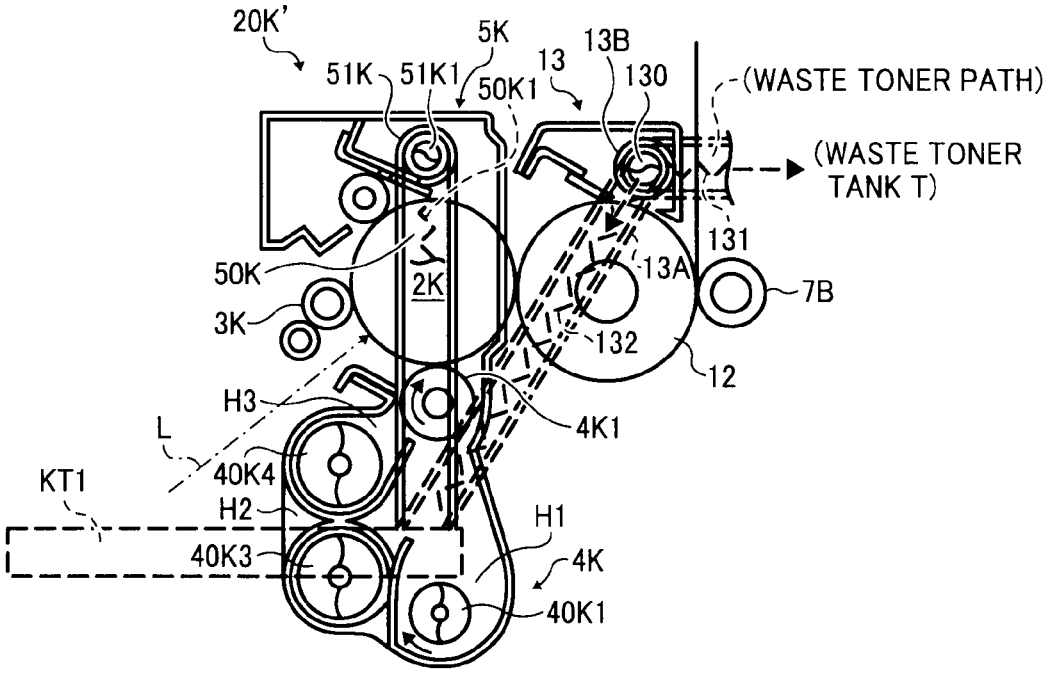
FIG. 10 is a schematic view of a modified configuration of the black image forming unit of FIG. 6.

Referring to FIG. 10, a description is given of an image forming unit 20K' according to a modified example of this exemplary embodiment of the present invention.

Elements or components of the image forming unit 20K' of FIG. 10 according to this modified example may be denoted by the same reference numerals as those of the image forming unit 20K of FIG. 6 according to an exemplary embodiment and the descriptions thereof are omitted or summarized.

As shown in FIG. 10, the image forming unit 20K' has a configuration in which the axis of the conveyance screw 40K3 has no angle or is not inclined or a configuration in which the developer agitation chamber H1 does not include the agitation paddle 40K2 is also applicable so as to reduce the size of the overall image forming apparatus 1.

Figure 11:
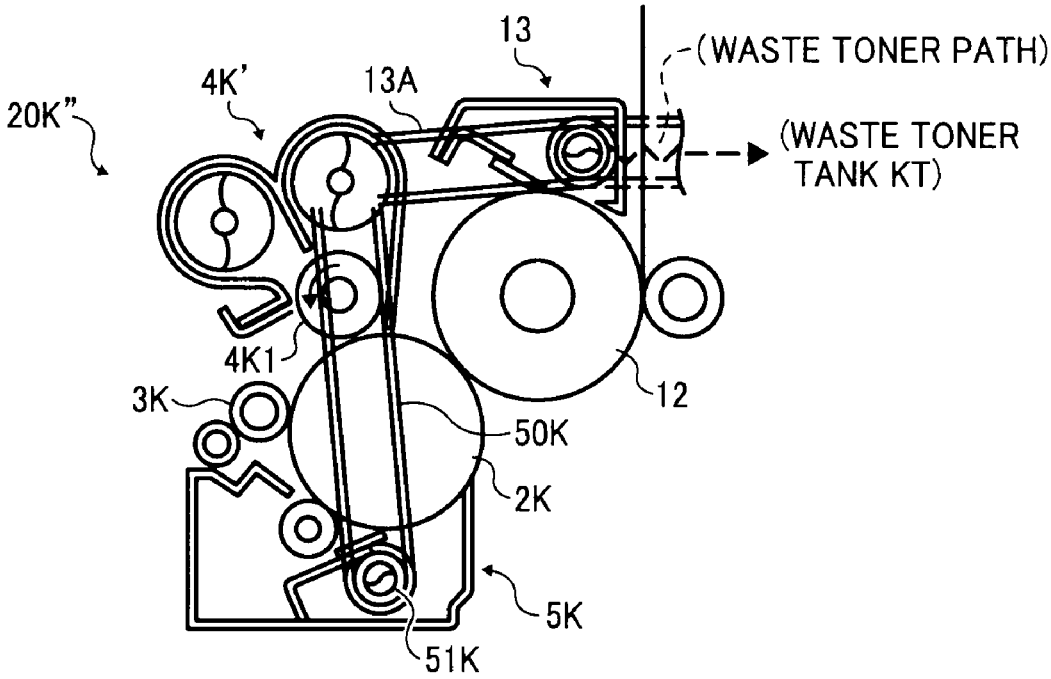
FIG. 11 is a schematic view of another modified configuration of the black image forming unit of FIG. 6.
Figure 12:
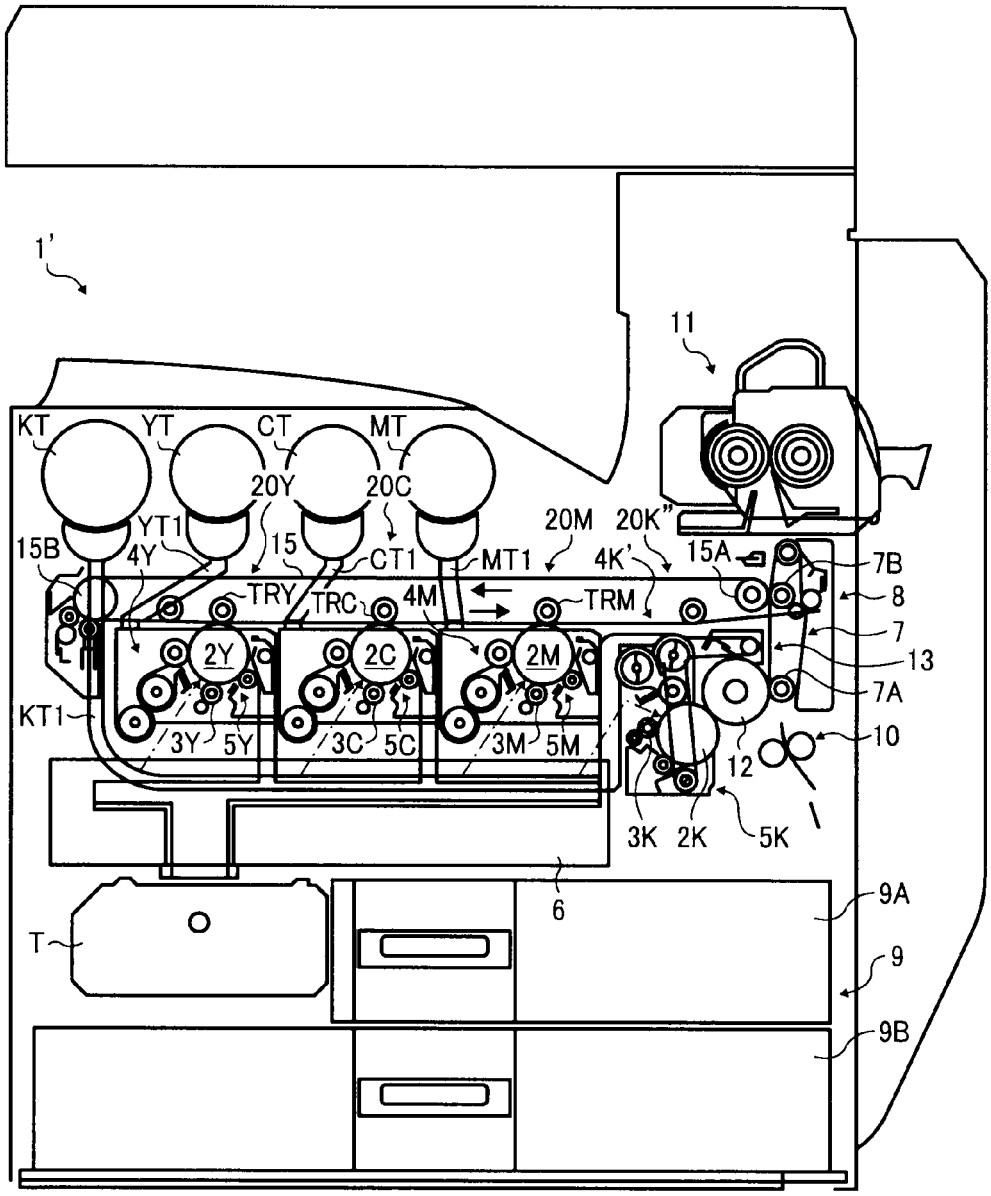
FIG. 12 is a schematic view of an image forming apparatus incorporating the black image forming unit of FIG. 11.

Further referring to FIGS. 11 and 12, a description is given of an image forming unit 20K" according to another modified example of this exemplary embodiment of the present invention.

Elements or components of the image forming unit 20K" of FIG. 11 and an image forming apparatus 1' of FIG. 12 according to this modified example may be denoted by the same reference numerals as those of the image forming unit 20K of FIG. 6 and the image forming apparatus 1 of FIG. 3 according to an exemplary embodiment and the descriptions thereof are omitted or summarized.

As shown in FIG. 11, the image forming unit 20K" has a configuration in which a developing unit 4K' is located above the photoconductor 2K and the cleaning unit 5K is located below the photoconductor 2K. In the image forming unit 20K" having this configuration shown in FIG. 11, the toner is conveyed from the residual toner collection unit 51K in an upward direction along the residual toner conveyance path 50K in the developing unit 4K'.

The photoconductor 2K rotates in a clockwise direction in FIG. 11 and the black image transfer member 12 rotates in a counterclockwise direction in FIG. 11.

FIG. 12 illustrates an entire view of the image forming apparatus 1' when the above-described developing unit 4K' shown in FIG. 11 is employed thereto.

The cleaning unit 5K that cleans the above-described photoconductor 2K and the transfer member cleaning unit 13 that cleans the black image transfer member 12 employ respective cleaning blades. These respective cleaning blades contact the photoconductor 2K and the black image transfer member 12 to remove the residual toner remaining thereon so as to convey the residual toner to the residual toner collection path 13A, the residual toner conveyance path 50K, the residual toner collection unit 51K and the like.

In the above-described configuration according to this exemplary embodiment, when only the monochrome image or black image is transferred onto the transfer sheet, only the image forming unit 20K operates to form the black image to be transferred onto the transfer sheet via the black image transfer member 12 while the image forming units 20Y, 20C, and 20M are not used.

Further, when only the black image is formed, the intermediate transfer belt 15 and the image forming units 20Y, 20C, and 20M and components for the image forming units 20Y, 20C, and 20M are stopped. Therefore, these units and components provided in the image forming units 20Y, 20C, and 20M other than the image forming units 20K are advantageous to have an extended period of useful life.

Further, it is desirable that the conveyance unit 7 facing and contacting the intermediate transfer belt 15 is separated from the intermediate transfer belt 15 so as to prevent the unnecessary transfer of black image onto the intermediate transfer belt 15.

The transfer sheet receives the black image at a transfer nip or position where the black image transfer member 12 and the belt member of the conveyance unit 7 sandwich or hold the transfer sheet therebetween.

Alternatively, the conveyance unit 7 can apply a bias voltage to attract and convey the transfer sheet.

In the image forming unit 20K after image transfer, the residual toner remaining on the photoconductor 2K is removed therefrom by the cleaning unit 5K, and is therefore returned to the developing unit 4K for recycling.

Similarly, the residual toner remaining on the black image transfer member 12 can be removed and collected by the transfer member clean unit 13 after image transfer. As described above, the conveyance form of the collected residual toner is specified by the controller 1000.

Figure 13:
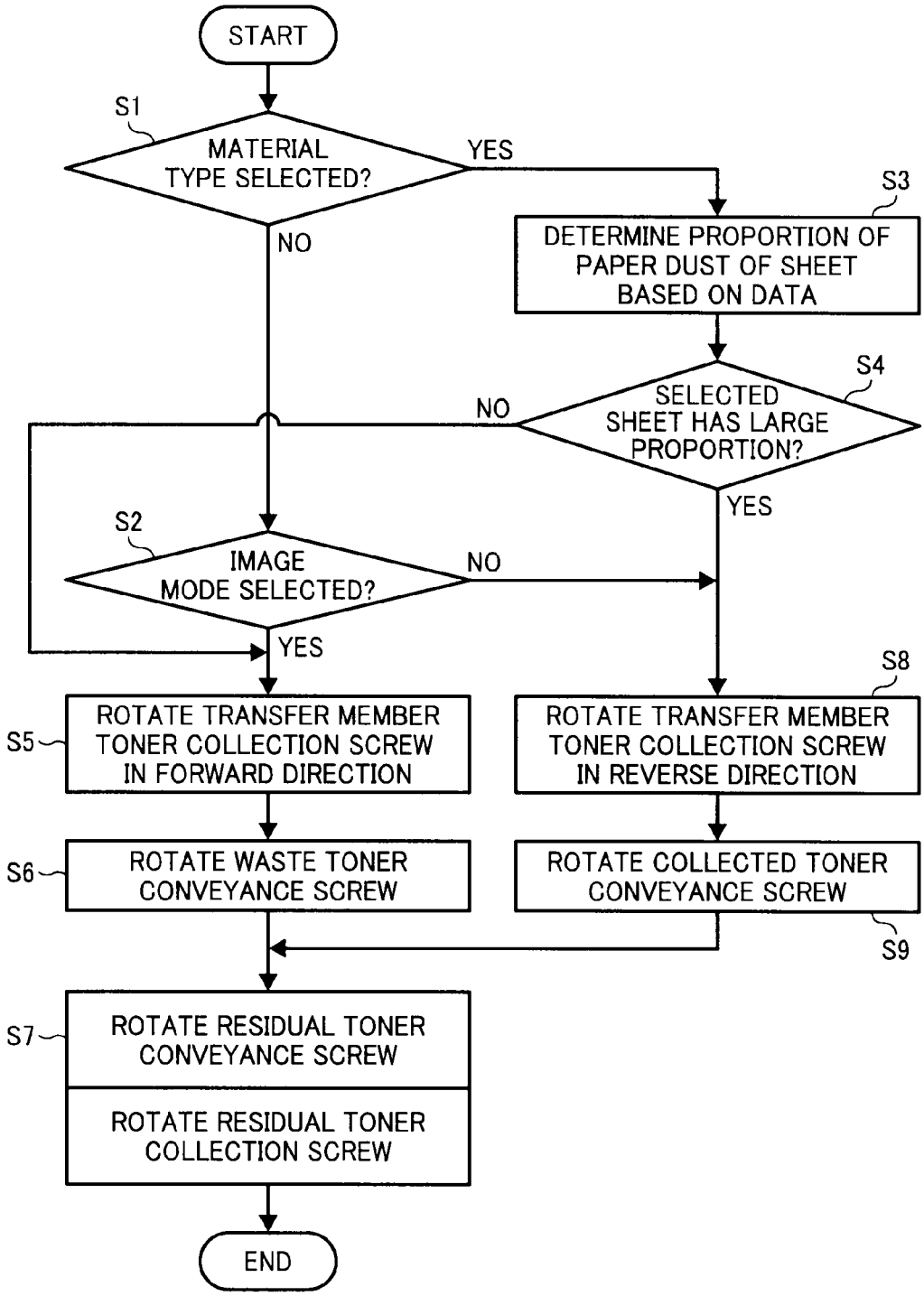
FIG. 13 is a flowchart of operations performed by the controller of FIG. 4.

FIG. 13 shows a flowchart to explain operations of the controller 1000 shown in FIG. 4.

The controller 1000 specifies and sets the conveyance form of the residual toner collected from the black image transfer member 12 according to each item selected through the operation panel 1001. The conveyance form may be determined to correspond to a case when a user selects any key of the material type key 1001A and the image mode selection key 1001B through the operation panel 1001.

In the flowchart of FIG. 13, detailed procedures are described.

In step S1 of the flowchart of FIG. 13, the controller 1000 determines whether or not the user has selected the material type key 1001A for the transfer sheet.

When the user has not selected any material type key 1001A, the result of step S1 is NO, and the process proceeds to step S2 (to determine whether the user has selected the image mode selection key 1001B).

When the user has selected the material type key 1001A, the result of step S1 is YES, and the process proceeds to step S3.

In step S3, the controller 1000 refers to previously registered data of amounts of possible production of paper dust that are grouped and mapped, and determines the proportion of paper dust of the selected material type of the transfer sheet. Then, in step S4, the controller 1000 determines the selected transfer sheet has a large proportion of paper dust to determine the conveyance form of the residual toner in the image quality mode and the normal mode according to the result of step S3.

When the user has selected the high image quality mode through the operation panel 1001 in step S2, the result of step S2 is YES, and the controller 1000 rotates the transfer member toner collection screw 130 provided in the residual toner collection unit 13B in the forward direction in step S5. With this action, the residual toner remaining in the residual toner collection unit 13B is conveyed to the waste toner path, as shown in FIG. 9.

As the transfer member toner collection screw 130 rotates in the forward direction in step S5, the waste toner conveyance screw 131 provided in the waste toner path is rotated toward the waste toner tank T in a direction of conveyance of residual toner, in step S6. With this action, the residual toner containing paper dust is discarded and not returned to the developing unit 4K. Therefore, when the high quality image mode is selected, the residual toner including a relatively large proportion of paper dust may not be used again. Consequently, degradation in image quality (i.e., white streaks and contamination) caused by paper dust can be prevented.

In the flowchart of FIG. 13, the residual toner collected from the photoconductor 2K is returned to the developer agitation chamber H1 of the developing unit 4K by the residual toner conveyance screw 50K1 incorporated in the residual toner conveyance path 50K and the residual toner collection screw 51K1 incorporated in the residual toner collection unit 51K in step S7. With this action, the residual toner returned to the developer agitation chamber H1 of the developing unit 4K can be used as recycled toner.

By contrast, when the user has not selected the high image quality mode but the normal image quality mode through the operation panel 1001 in step S2, the result of step S2 is NO, and the process proceeds to steps S8 and S9 to increase the amount of residual toner collected from the black image transfer member 12 for recycling.

Specifically, in step S8, the controller 1000 rotates the transfer member toner collection screw 130 that is provided in the residual toner collection unit 13B in a backward or reverse direction. With this action, the residual toner remaining in the residual toner collection unit 13B is conveyed to the residual toner collection path 13A to the developing unit 4K.

As the transfer member toner collection screw 130 rotates in the reverse direction in step S8, the collected toner conveyance screw 132 provided in the residual toner collection path 13A is rotated, in step S9. With this action, the residual toner containing little or relatively small proportion of paper dust is conveyed back to the developing unit 4K to be reused as recycled toner. Further, the residual toner collected from the photoconductor 2K is also returned to the developing unit 4K to be used as recycled toner, which leads to the same result as the process in step S7.

In the above-described exemplary embodiment, the conveyance form of the residual toner collected from the black image transfer member 12 is specified based on the type of transfer sheet and the image quality mode selected by the user. However, the present invention is not limited thereto.

For example, only the above-described image quality modes can be used as input information for the controller 1000.

Further, besides the above-described information inputting, it is possible to automatically detect the proportion of paper dust contained in the transfer sheet. For example, a direction of conveyance of transfer sheet accommodated in the sheet feed cassettes 9A and 9B, that is, landscape or portrait, can be detected and/or the size of the transfer sheet, particularly, the width direction that is a direction perpendicular to a direction of conveyance of the transfer sheet can be detected.

Such detection is performed because, when the length of the transfer sheet is placed within the longitudinal length of the cleaning blade along an axis of the photoconductor 2K, paper dust can be accumulated easily at a part or parts of the cleaning blade. Particularly, when transfer sheets having a width smaller than the maximum passable width of the transfer sheet on each image carrier are frequently conveyed, paper dust from the transfer sheets can accumulate at the same position of a cleaning blade of the cleaning unit 5K. Examples of such a transfer sheet are recycled paper, medium quality paper, paper with additives and the like. That is, when the above-described condition is satisfied, the residual toner including a substantially large proportion of paper dust is accumulated, and therefore the large proportion of paper dust can be included in the collected residual toner. Therefore, when the residual toner is determined to contain a large proportion of paper dust, the residual toner is discarded and not returned to the developing unit 4K.

Further, besides the comparison of the size of transfer sheet and the length of cleaning blade, a sensor can be disposed in the conveyance path of the transfer sheet to detect an amount of adhesion of paper dust, so that the conveyance form of the residual toner can be determined based on the detection result. Specifically, when it is determined that the proportion of paper dust is large, the same conveyance form of residual toner as the high image quality mode can be specified.

By contrast, when the full-color image is formed, after the black image is transferred onto the transfer sheet in the image forming unit 20K, the transfer sheet is conveyed to a transfer position with the intermediate transfer belt 15, where the transfer sheet faces the roller 15A and the transfer roller 7B. At the transfer position, the three-color composite image formed on the intermediate transfer belt 15 is transferred onto the transfer sheet.

The black image transfer member 12 after image transfer of the black image is, as described above, the conveyance form of residual toner to be collected from the transfer member cleaning unit 13 is specified corresponding to the selected type of transfer sheet or the selected image quality mode.

As described above, in the image forming unit 20K, only the residual toner removed from the photoconductor 2K is returned to the developing unit 4K while the residual toner removed from the black image transfer member 12 is discarded and not returned to the developing unit 4K, and therefore the developer in the developing unit 4K may not be mixed with paper dust. As a result, a defected regulation of thickness of layer of developer that can occur when the residual toner containing paper dust is returned to the developing unit 4K and contamination caused by adhesion of paper dust to the transfer sheet can be prevented.

Next, a description is given of another exemplary embodiment of the present invention.

This exemplary embodiment has a feature that the black image transfer member 12 includes an elastic member on a surface thereof. That is, even when the black image transfer member 12 has the surface that is unsmooth and uneven with convex and concave portions, an elastic member is mounted on the surface thereof so that the black image transfer member 12 can contact the transfer sheet evenly. With this configuration, the surface of the black image transfer member 12 and the surface of the transfer sheet can contact evenly. As a result, an effect of the transfer electric field due to the uniform contact of the black image transfer member 12 and the transfer sheet can be maintained, thereby obtaining an image without having unevenness in transfer.

In this exemplary embodiment, a roller including a surface layer of rubber roller or elastic film member is used as the black image transfer member 12 having an elastic layer.

Next, descriptions are given of toner used in the image forming apparatus 1 according to an exemplary embodiment of the present invention.

The toner of the present invention includes at least a binder resin and a colorant. The lubricant scraped from a molded lubricant, not shown, may be added to the surface of the toner to reduce friction. In addition, the toner of the present invention may optionally include a charge controlling agent for controlling charging ability of the toner, a release agent for increasing a releasing ability of the toner with respect to the fixing unit 11, and an external additive for enhancing fluidity of the toner.

(Binder Resin)

Suitable binder resins for use in the toner of the present invention include ester resins, vinyl resins, amide resins, epoxy resins, silicone resins, etc. These resins can be used alone or in combination. Of these resins, preferably vinyl resins are used.

Specific examples of the binder resins include styrene polymers and substituted styrene polymers such as polystyrene, poly-p-chlorostyrene and polyvinyltoluene; and styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-acrylonitrile copolymers, styrene-vinyl methyl ether copolymers, styrene-butadiene copolymers, styrene-methyl methacrylate-butyl acrylate copolymers, etc.

(Colorant)

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, red iron oxide, red lead, orange lead, cadmium red, cadmium mercury red, antimony orange, Permanent Red 4R, Para Red, Fire Red, p-chloro-o-nitroaniline red, LitholFast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, Pigment Green B, Naphthol Green B, Green Gold, titanium oxide, zinc oxide, lithopone and the like. These materials are used alone or in combination.

A content of the colorant in the toner is preferably from 1% to 15% by weight, and more preferably from 3% to 10% by weight, based on total weight of the toner.

(Charge Controlling Agent)

Suitable charge controlling agents for use in the toner of the present invention include compounds including salicylic acid, Nigrosine dyes, compounds including quaternary ammonium salts, compounds including alkylpyridinium, etc. The contained amount of such charge controlling agent with respect to the toner is generally in a range of from 0.1% to 5%, preferably in a range of from 1% to 3%.

(Release Agent)

Suitable release agents for use in the toner of the present invention include polyolefin waxes such as low-molecular-weight polyethylene, low-molecular-weight polypropylene, copolymers of low-molecular-weight polyethylene and low-molecular-weight polypropylene, etc.; ester waxes such as lower alcohol fatty acid ester, higher alcohol fatty acid ester, polyol fatty acid ester, etc.; amide wax, and etc. The contained amount of such release agent with respect to the toner is generally in a range of from 0.5% to 10%, preferably in a range of from 1% to 5%.

Preferably, the toner particle has an average circularity of from approximately 0.92 to approximately 1.00.

The circularity is defined by the following equation 1:

Circularity *SR* of a particle=(circumference of circle identical in area with the projected grain image of the particle/circumference of the projected grain image) Equation 1.

As the shape of a toner particle is close to a truly spherical shape, the value of circularity becomes close to 1.00. The toner having a high circularity is easily influenced by a line of electric force when the toner is present on a carrier or a developing sleeve used for an electrostatic developing method, and an electrostatic latent image formed on the surface of the photoconductor 2 is faithfully developed by the toner along the line of electric force thereof.

When such toner is used in a known image forming apparatus, even if the cleaning blade or other cleaning member contacts or is abut against the photoconductor 2, the toner cannot be sufficiently removed. The insufficient removal of the toner may occur because the toner having a substantially spherical shape easily moves on the surface of the photoconductor 2.

To prevent the occurrence of the above-described condition, a force greater than a given force of the cleaning blade or other cleaning member when contacting the surface of the photoconductor 2 is applied to the cleaning blade 15*a* so that the cleaning blade or other cleaning member with the greater force can abut against the photoconductor 2 to effectively scrape the residual toner on the surface of the photoconductor 2. The greater force, however, may adversely affect the rotation speed or accuracy of travel of the photoconductor 2, resulting in a banding.

By contrast, in an exemplary embodiment of the present invention, both a lubricating unit and the toner may apply lubricant onto the surface of the photoconductor 2 to reduce the coefficient of friction on the surface of the photoconductor 2. With the above-described action, the transferability of toner during the transfer operation may be enhanced, that is, a greater amount of toner can be transferred onto a recording medium or an intermediate transfer member. The above-described increase of transfer amount of toner can reduce the residual toner on the surface of the photoconductor 2 and the load of the cleaning blade. At the same time, the residual toner can be reduced from the surface of the photoconductor 2 without causing a banding when the cleaning blade abuts against the surface of the photoconductor 2 with the greater force.

A circularity of a dry toner manufactured by a dry pulverization method is thermally or mechanically controlled to be within the above-described range. For example, a thermal method in which dry toner particles are sprayed with an atomizer together with hot air can be used for preparing a toner having a spherical form. That is a thermal process of ensphering the toner particle. Alternatively, a mechanical method in which a spherical toner can be prepared by agitating, dry toner particles in a mixer such as a ball mill, with a medium such as a glass having a low specific gravity can be used. However, aggregated toner particles having a large particle diameter are formed by the thermal method or fine powders are produced by the mechanical method. Therefore, it is necessary to subject the residual toner particles to a classifying treatment. If a toner is produced in an aqueous medium, the shape of the toner can be controlled by controlling the degree of agitation in the solvent removing step.

Further, a fluidizing agent can be added to the toner.

Examples of the fluidizing agent are fine particles of metallic oxide such as silica, titania, alumina, magnesia, zirconia, ferrite, magnetite, etc., and fine particles of metallic oxide processed by silane coupling agent, titanate coupling agent, or zircon-aluminate. It is preferable to use silica or titania that is hydrophobized by the above-described coupling agents. Silica including a primary particle with a small diameter thereof can contribute to an increase of fluidity of toner. Titania can control a charge amount of toner. It is more preferable to use silica and titania in combination.

Further, an amount of lubricant added to the surface of a toner particle is preferably in a range of from approximately 0.1% to approximately 2.0%.

The amount of lubricant below 0.1% is insufficient to supply to the surface of the photoconductor 2, and it is difficult to reduce the coefficient of friction of the photoconductor 2.

In addition, the amount of lubricant above 2.0% can cause the toner held on the photoconductor 2 to adhere to the charge roller, resulting in a production of defect images.

In general, the smaller volume-based average particle diameter Dv the toner has, the better thin line reproducibility the toner has. Therefore, it is preferable the toner has the volume-based average particle diameter Dv of less than 8 μm. However, the smaller volume-based average particle diameter the toner has, the worse developing and cleaning properties the toner has. Therefore, it is preferable the toner has the volume-based average particle diameter Dv of greater than 3 μm.

When the toner has the volume-based average particle diameter Dv of less than 3 μm, a greater amount of very fine toner particles, which are difficult to be developed, are held on the respective surface of the carriers or on the surface of the developing roller. Therefore, the toner other than toner including the very fine toner particles cannot sufficiently contact or rub the carrier or the developing roller. The above-described insufficient contact can increase an amount of the reversely charged toner, resulting in a production of defect image such as an image having fogging on the background area. Accordingly, it is preferable that the toner has the volume-based average particle diameter Dv of greater than 3 μm.

Particle diameter distribution of toner indicated based on a ratio of the volume-based average particle diameter Dv to a number-based average particle diameter Dn is preferable to be in a range from approximately 1.05 to approximately 1.40. A sharp control of the distribution of the toner particle diameters, the distribution of the toner charge can be uniform. When the ratio Dv/Dn is greater than 1.40, the amount of the irregular charge toner becomes large and it becomes hard to produce an image having high resolution and high quality. A toner particle having the ratio Dv/Dn less than 1.05 is difficult to produce and is impractical to use. The above-described particle diameter of toner can be measured by, for example, a Coultar counter method using a measuring instrument for measuring particle diameter distribution of toner, such as, Coultar counter multisizer (manufactured by Coulter Electronics Limited). By using the above-described measuring instrument, the particle diameter of toner may be obtained with a 50 μm aperture, by measuring the average of particle diameters of 50,000 toner particles.

It is preferable that a shape factor "SF-1" of the toner used in each of the developing units 4Y, 4C, 4M, and 4K is in a range of from approximately 100 to approximately 180, and the shape factor "SF-2" of the toner used in each of the developing units 4Y, 4C, 4M, and 4K is in a range of from approximately 100 to approximately 180.

Figure 14A:
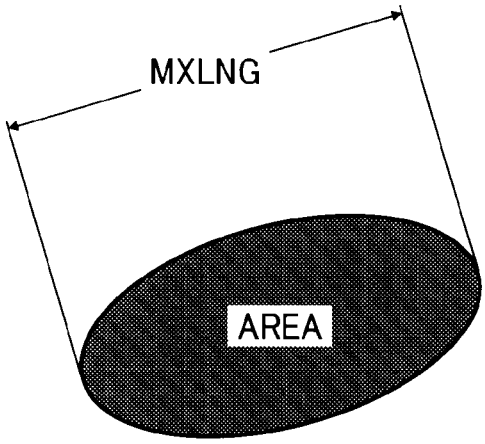
FIG. 14A is a schematic drawing of a toner having an "SF-1" shape factor.

Referring to FIG. 14A, the shape factor "SF-1" is a parameter representing the roundness of a particle.

The shape factor "SF-1" of a particle is calculated by a following Equation 1:

$$\text{SF-1}=\{(MXLNG)^2/\text{AREA}\}\times(100\pi/4) \qquad \text{Equation 1,}$$

where "MXLNG" represents the maximum major axis of an elliptical-shaped figure obtained by projecting a toner particle on a two dimensional plane, and "AREA" represents the projected area of elliptical-shaped figure.

When the value of the shape factor "SF-1" is 100, the particle has a perfect spherical shape. As the value of the "SF-1" increases, the shape of the particle becomes more elliptical.

Figure 14B:
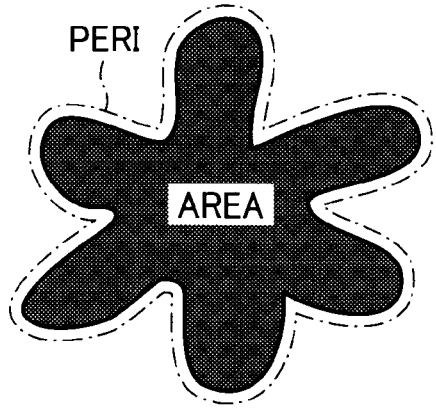
FIG. 14B is a schematic drawing of a toner having an "SF-2" shape factor.

Referring to FIG. 14B, the shape factor "SF-2" is a value representing irregularity (i.e., a ratio of convex and concave portions) of the shape of the toner. The shape factor "SF-2" of a particle is calculated by a following Equation 2:

$$\text{SF-2}=\{(PERI)^2/\text{AREA}\}\times(100\pi/4) \qquad \text{Equation 2,}$$

where "PERI" represents the perimeter of a figure obtained by projecting a toner particle on a two dimensional plane.

When the value of the shape factor "SF-2" is 100, the surface of the toner is even (i.e., no convex and concave portions). As the value of the "SF-2" increases, the surface of the toner becomes uneven (i.e., the number of convex and concave portions increase).

In this embodiment, toner images are sampled by using a field emission type scanning electron microscope (FE-SEM) S-800 manufactured by HITACHI, LTD. The toner image information is analyzed by using an image analyzer (LUSEX3) manufactured by NIREKO, LTD.

As the toner shape becomes spherical, a toner particle becomes held in point-contact with another toner particle or the photoconductor 2. Under the above-described condition, the toner adhesion force between two toner particles may decrease, resulting in the increase in toner fluidity, and the toner adhesion force between the toner particle and the photoconductor 2 may decrease, resulting in the increase in toner transferability. And, the toner storing unit may easily collect reversely charge toner.

Further, considering collecting performance, it is preferable that the values of the shape factors "SF-1" and "SF-2" are 100 or greater. As the values of the shape factors "SF-1" and "SF-2" become greater, the toner charge distribution becomes greater and a load to the toner storing unit becomes greater. Therefore, the values of the shape factors "SF-1" and "SF-2" are preferable to be less than 180.

Further, the toner used in the image forming apparatus 1 may be substantially spherical.

Figure 15A:
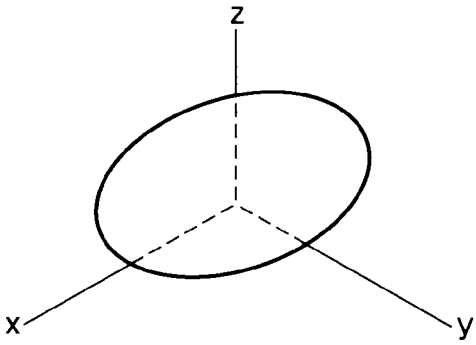
FIG. 15A is an outer shape of a toner used in the image forming apparatuses of FIGS. 3 and 12.
Figure 15B:
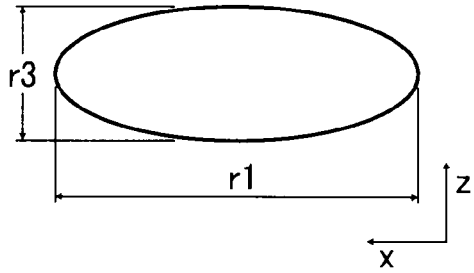
FIG. 15B is a schematic cross-sectional view of the toner, showing major and minor axes and a thickness of FIG. 15A.
Figure 15C:
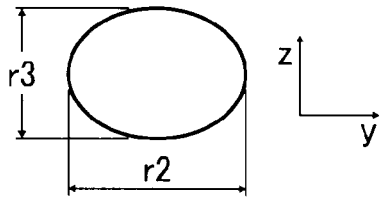
FIG. 15C is a schematic cross-sectional view of the toner, showing major and minor axes and a thickness of FIG. 15A.

Referring to FIGS. 15A, 15B, and 15C, sized of the toner is described. An axis "x" of FIG. 15A represents a major axis "r1" of FIG. 15B, which is the longest axis of the toner. An axis "y" of FIG. 15A represents a minor axis "r2" of FIG. 15B, which is the second longest axis of the toner. The axis "z" of FIG. 15A represents a thickness "r3" of FIG. 15B, which is a thickness of the shortest axis of the toner. The toner has a relationship between the major and minor axes "r1" and "r2" and the thickness "r3" as follows:

$$r1 \geqq r2 \geqq r3.$$

The toner of FIG. 15A is preferably in a spindle shape in which the ratio (r2/r1) of the major axis "r1" to the minor axis "r2" is approximately 0.5 to approximately 1.0, and the ratio (r3/r2) of the thickness "r3" to the minor axis "r2" is approximately 0.7 to approximately 1.0.

When the ratio (r2/r1) is less than approximately 0.5, the toner has an irregular particle shape, and the value of the toner charge distribution increases.

When the ratio (r3/r2) is less than approximately 0.7, the toner has an irregular particle shape, and the value of the toner charge distribution increases. When the ratio (r3/r2) is approximately 1.0, the toner has a substantially round shape, and the value of the toner charge distribution decreases.

The lengths showing with "r1", "r2" and "r3" can be monitored and measured with scanning electron microscope (SEM) by taking pictures from different angles.

The shape of toner depends on the manufacturing method used. For example, a toner particle produced by a dry type grinding method has an irregular shape with an uneven surface. The irregular-shaped toner, however, can be modified to an approximately round toner by being subjected to a mechanical treatment or a thermal treatment. Toner produced by a method such as a suspension polymerization method and an emulsion polymerization method may have a smooth surface and a perfectly spherical form. In this regard, spherical form can be charged to elliptic form by performing agitating in a middle of reaction, i.e., applying a shearing force to the toner.

A toner having a substantially spherical shape is preferably prepared by a method in which a toner composition including a polyester prepolymer having a function group including a nitrogen atom, a polyester, a colorant, and a releasing agent is subjected to an elongation reaction and/or a crosslinking reaction in an aqueous medium in the presence of fine resin particles. Since thus prepared toner has a hardened surface, the toner has a good hot offset resistance. Therefore, toner hardly causes a problem in that toner particles adhere to the fixing unit 30, which would resulting in degradation in the resultant copy image.

Toner constituents and preferable manufacturing method of the toner of the prevent invention will be described below.

(Polyester)

Polyester is produced by the condensation polymerization reaction of a polyhydric alcohol compound with a polyhydric carboxylic acid compound.

As the polyhydric alcohol compound (PO), dihydric alcohol (DIO) and polyhydric alcohol (TO) higher than trihydric alcohol can be used. In particular, a dihydric alcohol DIO alone or a mixture of a dihydric alcohol DIO with a small amount of polyhydric alcohol (TO) is preferably used. Specific examples of the dihydric alcohol (DIO) include alkylene glycol such as ethylene glycol, 1,2-propylene glycol, 1,3-propylene glycol, 1,4-butanediol, 1,6-hexanediol; alkylene ether glycol such as diethylene glycol, triethylene glycol, dipropylene glycol, polyethylene glycol, polypropylene glycol, polytetramethylene ether glycol; alicyclic diol such as 1,4-cyclohexane dimethanol, hydrogenated bisphenol A; bisphenols such as bisphenol A, bisphenol F, bisphenol S; adducts of the above-mentioned alicyclic diol with an alkylene oxide such as ethylene oxide, propylene oxide, butylenes oxide; adducts of the above-mentioned bisphenol with an alkylene oxide such as ethylene oxide, propylene oxide, butylenes oxide. In particular, alkylene glycol having 2 to 12 carbon atoms and adducts of bisphenol with an alkylene oxide are preferably used, and a mixture thereof is more preferably used. Specific examples of the polyhydric alcohol (TO) higher than trihydric alcohol include multivalent aliphatic alcohol having tri-octa hydric or higher hydric alcohol such as glycerin, trimethylolethane, trimethylolpropane, pentaerythritol and sorbitol; phenol having tri-octa hydric or higher hydric alcohol such as trisphenol PA, phenolnovolak, cresolnovolak; and adducts of the above-mentioned polyphenol having tri-octa hydric or higher hydric alcohol with an alkylene oxide.

As the polycarboxylic acid (PC), dicarboxylic acid (DIC) and polycarboxylic acids having 3 or more valences (TC) can be used. A dicarboylic acid (DIC) alone, or a mixture of the dicarboxylic acid (DIC) and a small amount of polycarboxylic acid having 3 or more valences (TC) is preferably used. Specific examples of the dicarboxylic acids (DIC) include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the polycarboxylic acid having 3 or more valences (TC) include aromatic polycarboxylic acids having 9 to 20 carbon atoms such as trimellitic acid and pyromellitic acid. The polycarboxylic acid (PC) can be formed from a reaction between the above-mentioned acids anhydride or lower alkyl ester such as methyl ester, ethyl ester and isopropyl ester.

The polyhydric alcohol (PO) and the polycarboxylic acid (PC) are mixed such that the equivalent ratio ([OH]/[COOH]) between the hydroxyl group [OH] of the poly hydric alcohol (PO) and the carboxylic group [COOH] of the polycarboxylic acid (PC) is typically from 2/1 to 1/1, preferably from 1.5/1 to 1/1 and more preferably from 1.3/1 to 1.02/1.

In the condensation polymerization reaction of a polyhydric alcohol (PO) with a polyhydric carboxylic acid (PC), the polyhydric alcohol (PO) and the polyhydric carboxylic acid (PC) are heated to a temperature from approximately 150° C. to approximately 280° C. in the presence of a known esterification catalyst, e.g., tetrabutoxy titanate or dibutyltineoxide. The generated water is distilled off with pressure being lowered, if necessary, to obtain a polyester resin containing a hydroxyl group. The hydroxyl value of the polyester resin is preferably 5 or more while the acid value of polyester is usually between 1 and 30, and preferably between 5 and 20. When a polyester resin having such an acid value is used, the residual toner is easily negatively charged. In addition, the affinity of the toner for recording paper can be improved, resulting in improvement of low temperature fixability of the toner. However, a polyester resin with an acid value above 30 can adversely affect stable charging of the residual toner, particularly when the environmental conditions vary.

The weight-average molecular weight of the polyester resin is from 10,000 to 400,000, and more preferably from 20,000 to 200,000. A polyester resin with a weight-average molecular weight between 10,000 lowers the offset resistance of the residual toner while a polyester resin with a weight-average molecular weight above 400,000 lowers the temperature fixability.

A urea-modified polyester is preferably included in the toner in addition to unmodified polyester produced by the above-described condensation polymerization reaction. The urea-modified polyester is produced by reacting the carboxylic group or hydroxyl group at the terminal of a polyester obtained by the above-described condensation polymerization reaction with a polyisocyanate compound (PIC) to obtain polyester prepolymer (A) having an isocyanate group, and then reacting the prepolymer (A) with amines to crosslink and/or extend the molecular chain.

Specific examples of the polyisocyanate compound (PIC) include aliphatic polyvalent isocyanate such as tetra methylenediisocyanate, hexamethylenediisocyanate, 2,6-diisocyanate methyl caproate; alicyclic polyisocyanate such as isophoronediisocyanate, cyclohexylmethane diisocyanate; aromatic diisocyanate such as tolylenediisocyanate, diphenylmethene diisocyanate; aroma-aliphatic diisocyanate such as α,α,α',α',-tetramethylxylene diisocynate; isocaynates; the above-mentioned isocyanats blocked with phenol derivatives, oxime, caprolactam; and a combination of two or more of them.

The polyisocyanate compound (PIC) is mixed such that the equivalent ratio ([NCO]/[OH]) between an isocyanate group [NCO] and a hydroxyl group [OH] of polyester having the isocyanate group and the hydroxyl group is typically from 5/1 to 1/1, preferably from 4/1 to 1.2/1, and more preferably from 2.5/1 to 1.5/1. A ratio of [NCO]/[OH] higher than 5 can deteriorate low-temperature fixability. As for a molar ratio of [NCO] below 1, if the urea-modified polyester is used, then the urea content in the ester is low, lowering the hot offset resistance.

The content of the constitutional unit obtained from a polyisocyanate (PIC) in the polyester prepolymer (A) is from 0.5% to 40% by weight, preferably from 1% to 30% by weight and more preferably from 2% to 20% by weight. When the content is less than 0.5% by weight, hot offset resistance of the resultant toner deteriorates and in addition the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diamino cyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, molecular weight of the urea-modified polyester decreases, resulting in deterioration of hot offset resistance of the resultant toner.

Suitable polyester resins for use in the toner of the present invention may include a urea-modified polyesters. The urea-modified polyester may include a urethane bonding as well as a urea bonding. The molar ratio (urea/urethane) of the urea bonding to the urethane bonding is from 100/0 to 10/90, preferably from 80/20 to 20/80, and more preferably from 60/40 to 30/70. When the molar ratio of the urea bonding is less than 10%, hot offset resistance of the resultant toner deteriorates.

The urea modified polyester is produced by, for example, a one-shot method. Specifically, a polyhydric alcohol (PO) and a polyhydric carboxylic acid (PC) are heated to a temperature of approximately 150° C. to approximately 280° C. in the presence of the known esterification catalyst, e.g., tetrabutoxy titanate or dibutyltineoxide to be reacted. The resulting water is distilled off with pressure being lowered, if necessary, to obtain a polyester containing a hydroxyl group. Then, a polyisocyanate (PIC) is reacted with the polyester obtained above a temperature of from approximately 40° C. to approximately 140° C. to prepare a polyester prepolymer (A) having an isocyanate group. The prepolymer (A) is further reacted with an amine (B) at a temperature of from 0° C. to approximately 140° C. to obtain a urea-modified polyester.

At the time of reacting the polyisocyanate (PIC) with a polyester and reacting the polyester prepolymer (A) with the amines (B), a solvent may be used, if necessary. Specific examples of the solvent include solvents inactive to the isocyanate (PIC), e.g., aromatic solvents such as toluene, xylene; ketones such as acetone, methyl ethyl ketone, methyl isobutyl ketone; esters such as ethyl acetate; amides such as dimethyl formamide, dimethyl acetatamide; and ethers such as tetrahydrofuran.

If necessary, a reaction terminator may be used for the crosslinking reaction and/or extension reaction of a polyester prepolymer (A) with an amine (B), to control the molecular weight of the resultant urea-modified polyester. Specific examples of the reaction terminators include a monoamine such as diethylamine, dibutylamine, butylamine, lauryl amine, and blocked substances thereof such as a ketimine compound.

The weight-average molecular weight of the urea-modified polyester is not less than 10,000, preferably from 20,000 to 10,000,000 and more preferably from 30,000 to 1,000,000. A molecular weight of less than 10,000 deteriorates the hot offset resisting property. The number-average molecular weight of the urea-modified polyester is not particularly limited when the after-mentioned unmodified polyester resin is used in combination. Namely, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000, and more preferably from 2,000 to 8,000. When the number-average molecular weight is greater than 20,000, the low temperature fixability of the resultant toner deteriorates, and in addition the glossiness of full color images deteriorates.

In the present invention, not only the urea-modified polyester alone but also the unmodified polyester resin can be included with the urea-modified polyester. A combination thereof improves low temperature fixability of the resultant toner and glossiness of color images produced by the image forming apparatus 1, and using the combination is more preferable than using the urea-modified polyester alone. It is noted that the unmodified polyester may contain polyester modified by a chemical bond other than the urea bond.

It is preferable that the urea-modified polyester at least partially mixes with the unmodified polyester resin to improve the low temperature fixability and hot offset resistance of the resultant toner. Therefore, the urea-modified polyester preferably has a structure similar to that of the unmodified polyester resin.

A mixing ratio between the urea-modified polyester and polyester resin is from 20/80 to 95/5 by weight, preferably from 70/30 to 95/5 by weight, more preferably from 75/25 to 95/5 by weight, and even more preferably from 80/20 to 93/7 by weight. When the weight ratio of the urea-modified polyester is less than 5%, the hot offset resistance deteriorates, and in addition, it is difficult to impart a good combination of high temperature preservability and low temperature fixability of the toner.

The toner binder preferably has a glass transition temperature (Tg) of from 45° C. to 65° C., and preferably from 45° C. to 60° C. When the glass transition temperature is less than 45° C., the high temperature preservability of the toner deteriorates. When the glass transition temperature is higher than 65° C., the low temperature fixability deteriorates.

Since the urea-modified polyester can exist on the surfaces of the mother toner particles, the toner of the present invention has better high temperature preservability than conventional toners including a polyester resin as a binder resin even though the glass transition temperature is low.

Here, the colorant, charge controlling agent, release agent, external additive, and the like can be prepared by using conventional materials.

The method for manufacturing the toner is described.

The toner of the present invention is produced by the following method, but the manufacturing method is not limited thereto.

(Preparation of Toner)

First, a colorant, unmodified polyester, polyester prepolymer having isocyanate groups and a parting agent are dispersed into an organic solvent to prepare a toner material liquid.

The organic solvent should preferably be volatile and have a boiling point of 100° C. or below because such a solvent is easy to remove after the formation of the toner mother particles. More specific examples of the organic solvent includes one or more of toluene, xylene, benzene, carbon tetrachloride, methylene chloride, 1,2-dichloroethane, 1,1,2-trichloroethane, trichloro ethylene, chloroform, monochlorobenzene, dichloroethylidene, methyl acetate, ethyl acetate, methyl ethyl ketone, methyl isobutyl ketone, and so forth. Particularly, the aromatic solvent such as toluene and xylene; and a hydrocarbon halide such as methylene chloride, 1,2-dichloroethane, chloroform or carbon tetrachloride is preferably used. The amount of the organic solvent to be used should preferably 0 parts by weight to 300 parts by weight for 100 parts by weight of polyester prepolymer, more preferably 0 parts by weight to 100 parts by weight for 100 parts by weight of polyester prepolymer, and even more preferably 25 parts by weight to 70 parts by weight for 100 parts by weight of polyester prepolymer.

The toner material liquid is emulsified in an aqueous medium in the presence of a surfactant and organic fine particles.

The aqueous medium for use in the present invention is water alone or a mixture of water with a solvent which can be mixed with water. Specific examples of such a solvent include alcohols (e.g., methanol, isopropyl alcohol and ethylene glycol), dimethylformamide, tetrahydrofuran, cellosolves (e.g., methyl cellosolve), lower ketones (e.g., acetone and methyl ethyl ketone), etc.

The content of the aqueous medium is typically from 50 to 2,000 parts by weight, and preferably from 100 to 1,000 parts by weight, per 100 parts by weight of the toner constituents. When the content is less than 50 parts by weight, the dispersion of the toner constituents in the aqueous medium is not satisfactory, and thereby the resultant mother toner particles do not have a desired particle diameter. In contrast, when the content is greater than 2,000, the manufacturing costs increase.

Various dispersants are used to emulsify and disperse an oil phase in an aqueous liquid including water in which the toner constituents are dispersed. Specific examples of such dispersants include surfactants, resin fine-particle dispersants, etc.

Specific examples of the dispersants include anionic surfactants such as alkylbenzenesulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyldimethylammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycine, di(octylaminoethyle)glycine, and N-alkyl-N, N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylgl-utamate, sodium 3-{omega-fluoroalkyl(C6-C11)oxy}-1-alkyl(C3-C4) sulfonate, sodium, 3-lomega-fluoroalkanoyl(C6-C8)-N-ethylamino}-1-propanesulfonate, fluoroalkyl(C11-C20)carboxylic acids and their metal salts, perfluoroalkylcarboxylic acids (7C-13C) and their metal salts, perfluoroalkyl(C4-C12) sulfonate and their metal salts, perfluorooctanesulfonic acid diethanol amides, N-propyl-N-(2-hydroxyethyl-)perfluorooctanesulfone amide, perfluoroalkyl(C6-C10)sulfoneamidepropyltrimethylammonium salts, salts of perfluoroalkyl (C6-C10)-N-ethylsulfonylglycin, monoperfluoroalkyl(C6-C16)e-thylphosphates, etc.

Specific examples of the marketed products of such surfactants having a fluoroalkyl group include SARFRON (Registered) S-111, S-112 and S-113, which are manufactured by ASAHI GLASS CO., LTD.; FLUORAD (Registered) FC-93, FC-95, FC-98 and FC-129, which are manufactured by SUMITOMO 3M LTD.; UNIDYNE (Registered) DS-101 and DS-102, which are manufactured by DAIKIN INDUSTRIES, LTD.; MEGAFACE (Registered) F-110, F-120, F-113, F-191, F-812 and F-833 which are manufactured by DAINIPPON INK AND CHEMICALS, INC.; ECTOP EF-102, 103, 104, 105, 112, 123A, 123B, 306A, 501, 201 and 204, which are manufactured by TOHCHEM PRODUCTS CO., LTD.; FUTARGENT (Registered) F-100 and F150 manufactured by NEOS; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl(C6-C10)sulfone-amidepropyltrimethylammonium salts, benzalkonium salts, benzetonium chloride, pyridinium salts, imidazolinium salts, etc. Specific examples of the marketed products thereof include SARFRON (Registered) S-121 (manufactured by ASAHI GLASS CO., LTD.); FLUORAD (Registered) FC-135 (manufactured by SUMITOMO 3M LTD.); UNIDYNE DS-202 (manufactured by DAIKIN INDUSTRIES, LTD.); MEGAFACE (Registered) F-150 and F-824 (manufactured by DAINIPPON INK AND CHEMICALS, INC.); ECTOP EF-132 (manufactured by TOHCHEM PRODUCTS CO., LTD.); FUTARGENT (Registered) F-300 (manufactured by NEOS); etc.

Resin fine particles are added to stabilize toner source particles formed in aqueous solvent. The resin fine particles are preferably added such that the coverage ratio thereof on the surface of a toner source particle can be within 10% through 90%. For example, such resin fine particles may be methyl polymethacrylate particles of 1 μm and 3 μm, polystyrene particles of 0.5 μm and 2 μm, poly(styrene-acrylonitrile)particles of 1 μm, commercially, PB-200 (manufactured by KAO Co.), SGP, SGP-3G (manufactured by SOKEN), technopolymer SB (manufactured by SEKISUI PLASTICS CO., LTD.), micropearl (manufactured by SEKISUI CHEMICAL CO., LTD.) or the like.

Also, an inorganic dispersant such as calcium triphosphate, calcium carbonate, titanium oxide, colloidal silica, and hydroxyapatite may be used.

Further, it is possible to stably disperse toner constituents in water using a polymeric protection colloid in combination with the inorganic dispersants and/or particulate polymers mentioned above.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, (β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethyleneimine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethylcellulose and hydroxypropylcellulose, can also be used as the polymeric protective colloid.

The dispersion method is not particularly limited, and conventional dispersion facilities, e.g., low speed shearing type, high speed shearing type, friction type, high pressure jet type and ultrasonic type dispersers can be used. Among them, the high speed shearing type dispersion methods are preferable for preparing a dispersion including grains with a grain size of 2 μm to 20 μm. The number of rotation of the high speed shearing type dispersers is not particularly limited, but is usually 1,000 rpm (revolutions per minute) to 30,000 rpm, and preferably 5,000 rpm to 20,000 rpm. While the dispersion time is not limited, it is usually 0.1 minute to 5 minutes for the batch system. The dispersion temperature is usually 0° C. to 150° C., and preferably 40° C. to 98° C. under a pressurized condition.

At the same time as the production of the emulsion, an amine (B) is added to the emulsion to be reacted with the polyester prepolymer (A) having isocyanate groups.

The reaction causes the crosslinking and/or extension of the molecular chains to occur. The elongation and/or crosslinking reaction time is determined depending on the reactivity of the isocyanate structure of the prepolymer (A) and amine (B) used, but is typically from 10 minutes to 40 hours, and preferably from 2 hours to 24 hours. The reaction temperature is typically from 0° C. to 150° C., and preferably from 40° C. to 98° C. In addition, a known catalyst such as dibutyltinlaurate and dioctyltinlaurate can be used. The amines (B) are used as the elongation agent and/or crosslinker.

After the above reaction, the organic solvent is removed from the emulsion (reaction product), and the resultant particles are washed and then dried. Thus mother toner particles are prepared.

To remove the organic solvent, the entire system is gradually heated in a laminar-flow agitating state. In this case, when the system is strongly agitated in a preselected temperature range, and then subjected to a solvent removal treatment, fusiform mother toner particles can be produced. Alternatively, when a dispersion stabilizer, e.g., calcium phosphate, which is soluble in acid or alkali, is used, calcium phosphate is preferably removed from the toner mother particles by being dissolved by hydrochloric acid or similar acid, followed by washing with water. Further, such a dispersion stabilizer can be removed by a decomposition method using an enzyme.

Then a charge control agent is penetrated into the mother toner particles, and inorganic fine particles such as silica, titanium oxide etc. are added externally thereto to obtain the toner of the present invention.

When preparing the toner by mixing the mother toner particles with an external additive and the lubricant, the external additive and the lubricant may be added individually or at the same time. The mixing operation of the external additive and the lubricant with the mother toner particles can be carried out using a conventional mixer, which preferably includes a jacket to control the inner temperature of the mixer. Suitable mixers are V-type mixers, rocking mixers, Ledige mixers, nauter mixers and Henschel mixers. Preferably, the rotational speed, mixing time and/or mixing temperature are optimized to prevent embedding of the external additive into the mother toner particles and forming a thin layer on the surface of the lubricant.

Thus, a toner having a small particle size and a sharp particle distribution can be obtained easily. Moreover, by controlling the stirring conditions when removing the organic solvent, the particle shape of the particles can be controlled so as to be any shape between perfectly spherical and rugby ball shape. Furthermore, the conditions of the surface can also be controlled so as to be any condition between smooth surface and rough surface such as the surface of pickled plum.

The thus prepared toner is mixed with a magnetic carrier to be used as a two-component developer. In this case, the toner is included in the two-component developer in an amount of from 1 part by weight to 10 parts by weight per 100 parts by weight of the carrier. As an alternative, the toner of the present invention can be used as a one-component magnetic or non-magnetic developer.

In this exemplary embodiment, the cleaning unit for cleaning the photoconductor employs a blade cleaning method. However, the present invention can also apply a brush cleaning method in the cleaning unit. For example, the cleaning unit with the brush cleaning method can use a fur brush, a magnetic brush or the like.

Further, the optical writing unit can have a configuration in which a laser light beam and an LED can be selectively used.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. An image forming apparatus, comprising:

multiple image forming units disposed adjacent to and horizontally aligned with each other to form respective single non-black color images;

a first transfer member extending along and disposed in contact with the multiple image forming units to sequentially transfer and overlay the respective single non-black color images onto an extended surface thereof for forming a composite color image;

a black image forming unit disposed separately from the multiple image forming units to form a black image, the black image forming unit including a black image carrier to carry the black image on a surface thereof; and a black image developing unit to develop the black image with black toner;

a second transfer member disposed facing the black image carrier of the black image forming unit to transfer the black image from the black image forming unit onto a recording medium;

a first cleaning unit disposed facing the black image carrier to clean the surface of the black image carrier; and a second cleaning unit disposed facing the second transfer member to clean the surface of the second transfer member, the black toner removed from the surface of the black image carrier being collected and returned to the black image developing unit.

2. The image forming apparatus according to claim 1, wherein the second transfer member is disposed where the black image is transferred onto the recording medium before the composite color image is transferred onto the recording medium.

3. The image forming apparatus according to claim 1, wherein the second cleaning unit discards toner and paper dust collected from the surface of the second transfer member.

4. The image forming apparatus according to claim 1, wherein the surface of the second transfer member includes an elastic layer.

5. The image forming apparatus according to claim 1, wherein the toner contains particles having an average circularity of from approximately 0.92 to approximately 1.00.

6. The image forming apparatus according to claim 1, wherein the toner contains particles having a shape factor SF-1 in a range of from approximately 100 to approximately 180, and a shape factor SF-2 in a range of from approximately 100 to approximately 180.

7. The image forming apparatus according to claim 1, wherein the toner contains particles having a volume-based average particle diameter from approximately 3 μm to approximately 8 μm and a distribution of from approximately 1.05 to approximately 1.40, the distribution being defined by a ratio of the volume-based average particle diameter to a number-based average diameter.

8. The image forming apparatus according to claim 1, wherein the toner contains particles having a ratio of a major axis r1 to a minor axis r2 of from approximately 0.5 to approximately 1.0, and a ratio of a thickness r3 to the minor axis r2 of from approximately 0.7 to approximately 1.0; and $r1 \geqq r2 \geqq r3$.

9. The image forming apparatus according to claim 1, wherein the toner contains particles obtained from at least one of an elongation and a crosslinking reaction of toner composition comprising a polyester prepolymer having a function group including a nitrogen atom, a polyester, a colorant, and a releasing agent in an aqueous medium under resin fine particles.

10. The image forming apparatus according to claim 1, wherein:

the multiple image forming units respectively include multiple process cartridges, in each of which an image carrier and at least one of a charging unit, a developing unit, and a cleaning unit are integrally provided, the black image forming unit includes a black process cartridge in which the black image carrier and at least one of a black image charging unit, the black image developing unit, and the first cleaning unit are integrally provided, the multiple process cartridges and the black process cartridge are detachably attachable to the image forming apparatus, and the black toner removed from the black image carrier in the black process cartridge is collected as recycled toner and returned to the black image developing unit of the black process cartridge for forming black images.

* * * * *